US012351279B1

(12) United States Patent
Bi

(10) Patent No.: US 12,351,279 B1
(45) Date of Patent: Jul. 8, 2025

(54) INFLATABLE PADDLE BOARD WITH CENTRAL BALANCING FIN

(71) Applicant: Shandong Longming Information Technology Co., Ltd, Qingdao (CN)

(72) Inventor: Wentao Bi, Rongcheng (CN)

(73) Assignee: Shandong Longming Information Technology Co., Ltd, Qingdao (CN)

( * ) Notice: Subject to any disclaimer, the term of this patent is extended or adjusted under 35 U.S.C. 154(b) by 0 days.

(21) Appl. No.: 18/773,625

(22) Filed: Jul. 16, 2024

(51) Int. Cl.
*B63B 32/51* (2020.01)
*B63B 32/62* (2020.01)

(52) U.S. Cl.
CPC ..... *B63B 32/51* (2020.02); *B63B 32/62* (2020.02)

(58) Field of Classification Search
CPC ..... B63B 32/51; B63B 32/62; B63B 7/08; B63B 7/082; B63B 7/085; B63B 7/087; B63B 32/60; B63B 32/64; B63B 32/66; B63B 41/00; B63B 2041/003; B63B 2041/006
See application file for complete search history.

(56) References Cited

U.S. PATENT DOCUMENTS

2013/0244514 A1* 9/2013 Scott ..... B63B 32/62 441/79
2015/0336634 A1* 11/2015 Swan ..... B63H 16/06 114/364
2018/0265174 A1* 9/2018 Miller ..... B63B 32/66

FOREIGN PATENT DOCUMENTS

DE 2801738 A1 * 8/1979
FR 3113885 A3 * 3/2022

* cited by examiner

*Primary Examiner* — Andrew Polay
(74) *Attorney, Agent, or Firm* — Ying-Ting Chen

(57) ABSTRACT

An inflatable paddle board includes a board body which is inflatable and a central balancing fin which is configured to be provided at a bottom of the board body, the central balancing fin increases the surface area in contact with the water, so as to provide additional lateral resistance, and this added resistance stabilizes the paddle board, making it less prone to tip over, and also maintain a straight trajectory by reducing the lateral drift.

18 Claims, 26 Drawing Sheets

A

B

INFLATABLE PADDLE BOARD WITH CENTRAL BALANCING FIN

BACKGROUND OF THE PRESENT INVENTION

Field of Invention

The present invention relates to paddle board, and more particular to an inflatable paddle board with central balancing fin for enhancing stability and improving navigation performance.

Description of Related Arts

Paddle board sports generally encompass a variety of activities that involve using a paddle to propel a board through the water. These sports are enjoyed by people of all ages and skill levels and can be practiced in various water environments, from calm lakes to ocean waves.

Inflatable paddle boards have surged in popularity in recent years, thanks to several advantages they offer over traditional hard shell boards. When being deflated, an inflatable paddle board is rolled up into a compact package that easily fits in a backpack, making it ideal for the user who wants to take his or her board on the go. This portability frees the user from needing roof racks to transport the board to the beach or lake.

However, the conventional inflatable paddle board has several disadvantages. The inflatable board might feel slightly wobbly, especially for beginners or in choppy water. And the user has to be constantly fighting to keep the board going straight. Every paddle stroke will likely cause the board to veer off course, making it frustrating and inefficient to paddle any distance. The constant need to correct the course with each stroke will quickly lead to fatigue, making even a short paddle feel like a workout. In addition, the conventional inflatable board has limited control over steering, and this can be dangerous in windy conditions or when navigating around obstacles.

SUMMARY OF THE PRESENT INVENTION

The invention is advantageous in that it provides an inflatable paddle board with central balancing fin, wherein the central balancing fin increases the surface area in contact with the water, providing additional lateral resistance. This added resistance stabilizes the board, making it less prone to tip over, which is especially beneficial for beginners or those paddling in choppy waters.

Another advantage of the present invention is to provide an inflatable paddle board with central balancing fin, wherein the central balancing fin acts as a keel, helping to maintain a straight trajectory by reducing lateral drift, so as to allow the user to maintain a consistent course with minimal effort, improving efficiency and reducing the need for constant correction.

Another advantage of the present invention is to provide an inflatable paddle board with central balancing fin, wherein the central balancing fin provide a stabilizing effect to reduce the side-to-side motion of the board. Les swaying means a more stable platform, which reduces the risk of falling, making the board safer and more user-friendly.

Another advantage of the present invention is to provide an inflatable paddle board with central balancing fin, wherein the central balancing fin improves directional control, so that the paddler can more easily steer and make precise adjustments to their heading, enhancing maneuverability and control.

Another advantage of the present invention is to provide an inflatable paddle board with central balancing fin, wherein the increased stability and reduced swaying lower the likelihood of losing balance and capsizing. This makes the board safer for various water conditions and user skill levels, encouraging a wider range of people to enjoy paddle boarding.

Another advantage of the present invention is to provide an inflatable paddle board with central balancing fin, wherein the inflatable paddle board is provided with one or more rear fins, the arrangement of the rear fins and the central balancing fin prevent the unwanted rotating movement of the board, so as to ensure the straight navigation of the paddle board.

Another advantage of the present invention is to provide an inflatable paddle board with central balancing fin, wherein the central balancing fin is configured to be detachably mounted to the bottom of the board body, so that the inflatable paddle board can be rolled up during storage and transportation.

Additional advantages and features of the invention will become apparent from the description which follows, and may be realized by means of the instrumentalities and combinations particularly pointing out in the appended claims.

According to the present invention, the foregoing and other objects and advantages are attained by an inflatable paddle board, comprising:

a board body which is inflatable; and a central balancing fin which is configured to be provided at a bottom of the board body.

According to an embodiment, the board body comprises a deck portion and a hull portion coupled to the deck portion, wherein the hull portion has a bottom surface, wherein the central balancing fin is fixed to the bottom surface of the hull portion at a central area of the bottom surface of the hull portion.

According to an embodiment, the board body comprises a deck portion and a hull portion coupled to the deck portion, wherein the hull portion has a bottom surface, wherein the central balancing fin is detachably mounted to the bottom surface of the hull portion at a central area of the bottom surface of the hull portion.

According to an embodiment, the bottom surface of the hull portion has a center position, wherein the central balancing fin has a center line which is perpendicular to a width of the central balancing fin, wherein when the central balancing fin is assembled on the bottom surface of the hull portion, the center line of the central balancing fin is aligned with the center position of the bottom surface of the hull portion.

According to an embodiment, wherein the bottom surface of the hull portion has a center position, wherein the central balancing fin has a center line which is perpendicular to a width of the central balancing fin, wherein when the central balancing fin is assembled on the bottom surface of the hull portion, the center line of the central balancing fin is deviated from the center position of the bottom surface of the hull portion along a length direction with a forward deviation distance within 30 cm and a backward deviation distance within 50 cm.

According to an embodiment, the bottom surface of the hull portion has a center position, wherein the central balancing fin has a center line which is perpendicular to a width of the central balancing fin, wherein when the central balancing fin is assembled on the bottom surface of the hull portion, the center line of the central balancing fin is deviated from the center position of the bottom surface of the hull portion along a length direction with an allowable deviation distance which is not more than 10 cm.

According to an embodiment, the bottom surface of the hull portion has a central line, wherein the inflatable paddle board comprises two the central balancing fins which are symmetrically distributed at two opposite sides of the central line of the bottom surface of the hull portion.

According to an embodiment, the board body further comprises a fixing holder which is fixed to the bottom surface of the hull portion, wherein the central balancing fin comprises an assembling base and a fin body which is extended from the assembling base, wherein the assembling base is detachably coupled with the fixing holder.

According to an embodiment, the fixing holder has a holding channel, an upper groove communicated to the holding channel an exit opening communicated to the holding channel, wherein the assembling base is detachably engaged with the holding channel through the exit opening to allow the fin body to be extended above the upper groove of the fixing holder.

According to an embodiment, the fixing holder has two recessed grooves formed at two opposite sides of the upper groove, wherein the assembling base has a retention hole, wherein the board body further comprises a retention pin, wherein when the assembling base is assembled on the fixing holder, the retention hole is aligned with the two recessed grooves, wherein the retention pin is arranged to be penetrate through the retention hole of the assembling base and the two recessed grooves of the fixing holder to retain the central balancing fin on the fixing holder.

According to an embodiment, the retention pin comprises a pin body and a biasing portion protruded from the pin body for biasing against the fin body of the central balancing fin when the retention pin is inserted into the retention hole of the assembling base and the two recessed grooves of the fixing holder.

According to an embodiment, the retention pin comprises an inserting end portion and an enlarged operation portion for being operated by a user, wherein when the said retention pin is inserted to penetrate through the retention hole of the assembling base, the inserting end portion and the enlarged operation portion are respectively seated in the two recessed grooves.

According to an embodiment, the inflatable paddle board further comprises a connecting rope which is used to connect the retention pin to the central balancing fin.

According to an embodiment, the fixing holder comprise a holding body and a fixing plate, wherein the holding body has a top surface and a surrounding wall extended between the fixing plate and the top surface of the holding body, wherein the surrounding wall is curvedly or inclinedly extended from the fixing plate to the top surface of the holding body.

According to an embodiment, the fixing holder comprises a holding body defining the holding channel, the upper groove and the two recessed grooves, wherein the fixing holder comprises two pairs of protrusion steps which are protruded from a top surface of the holding body, wherein each of the two pairs of protrusion steps comprises two protrusion steps which are respectively formed at two opposite sides of the corresponding recessed groove.

According to an embodiment, the central balancing fin comprises a fin body which comprises a front corner portion and a rear corner portion, wherein the front corner portion has a front arc edge, and the rear corner portion has a rear arc edge.

According to an embodiment, the front arc edge has a front corner radii, the rear arc edge has a rear corner radii, wherein the front corner radii is larger than the rear corner radii.

According to an embodiment, the central balancing fin has a height which is ranged from 150 mm-500 mm and a width which is ranged from 100 mm-400 mm.

According to an embodiment, the fin body has a gradually increasing thickness from a top of the fin body towards the assembling base, wherein a maximum thickness of the fin body is 3 mm-30 mm.

According to an embodiment, a length of the fixing holder is ranged from 150 mm-450 mm, a width of the fixing holder is ranged from 50 mm-150 mm, a height of the fixing holder is ranged from 5 mm-30 mm.

According to an embodiment, the inflatable paddle board further comprises one or more rear fins provided at a bottom of a rear end portion of the board body.

According to an embodiment, the bottom surface of the hull portion has a central line along a length of the hull portion, wherein the inflatable paddle board further comprises a first central rear fin, wherein the first central rear fin is aligned with the central balancing fin in a manner that the first central rear fin and the central balancing fin are both arranged along the central line of the bottom surface of the hull portion.

According to an embodiment, a size of the first central rear fin is smaller than a size of the central balancing fin.

According to an embodiment, the bottom surface of the hull portion has a central line along a length of the hull portion, wherein the inflatable paddle board further comprises two second rear fins which are symmetrically distributed at a bottom of a rear end portion of the board body on two opposite sides of the central line of the bottom surface of the hull portion.

According to an embodiment, a first rear fin body of the first central rear fin is constructed to has a first streamlined front curve edge and a first arched rear curve edge, a second rear fin body of each second rear fin is constructed to has a second streamlined front curve edge and a second arched rear curve edge.

According to an embodiment, the central balancing fin is made of a material selected from the group consisting of polypropylene, polyamide, and polycarbonate.

According to an embodiment, the board body is mainly made of a flexible material such as polyvinyl chloride, hypalon, nitrilon, polyurethane, ethylene-vinyl acetate and thermoplastic polyurethane.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
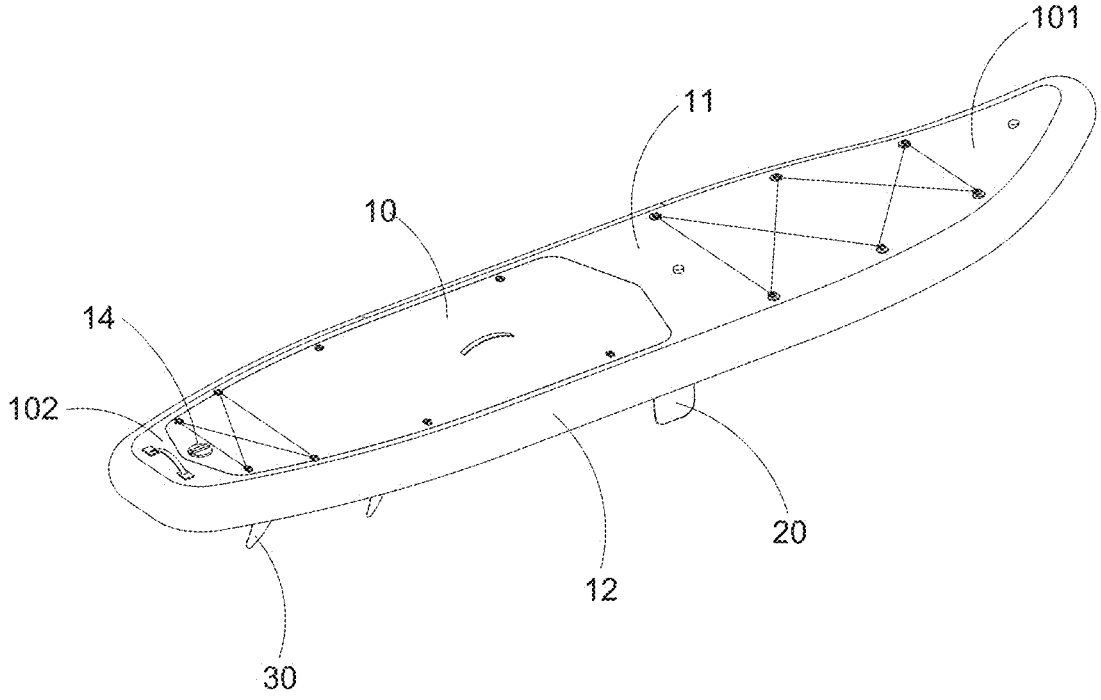
FIG. 1 is a perspective view of an inflatable paddle board according to a preferred embodiment of the present invention.
Figure 2:
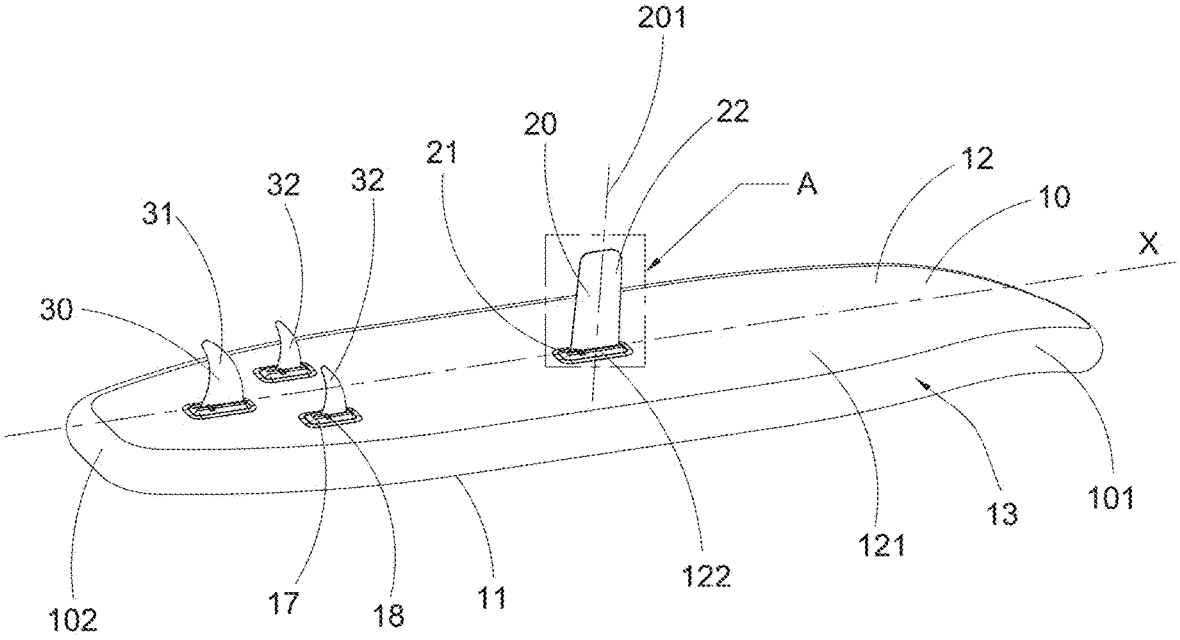
FIG. 2 is another perspective view illustrating a bottom structure of the inflatable paddle board according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Referring to FIGS. 1 to 16 and 21 to 25 of the drawings, an inflatable paddle board according to a preferred embodiment of the present invention is illustrated, the inflatable paddle board comprises a board body 10 and a central balancing fin 20 which is configured to be provided at a bottom of the board body 10.

The board body 10 is an inflatable body which comprises a deck portion 11, a hull portion 12 coupled to the deck portion 11 to define an inflatable chamber 13, an air valve 14 which is communicated to the inflatable chamber 13 for inflating the board body 10.

The board body 10 can be mainly made of a flexible material such as polyvinyl chloride, hypalon, nitrilon, polyurethane, ethylene-vinyl acetate and thermoplastic polyurethane. Additional material such as ethylene-vinyl acetate can be applied on the surface of the board. As an example, the deck portion 11 may be provided with an ethylene-vinyl acetate foam pad to provide a non-slip surface for traction and comfort underfoot. Both of the deck portion 11 and the bull portion 12 can be formed by a single layer or multiple layers.

The connection between the deck portion 11 and hull of an inflatable paddle board relies on advanced construction techniques like drop-stitch technology, layered PVC construction, rail bands, and either heat welding or adhesive bonding. These methods ensure that the board remains durable, rigid, and capable of withstanding the pressures of use while maintaining a lightweight and portable design The air valve 14 ensures that the board body 10 can be easily inflated and deflated while maintaining an airtight seal during use. Typical air valve can be but not limited to Halkey-Robersts Valve, Boton vale, Leafield C7 valve, Dinghy vale, and Military valve.

The central balancing fin 20 can be fixed to the bottom of the board body 10. Preferably, the central balancing fin 20 is detachably mounted to the bottom of the board body 10. More specifically, the central balancing fin 20 is detachably mounted to a bottom surface 121 of the hull portion 12 of the board body 10, so that during transportation, the central balancing fin 20 is detached from the hull portion 12 of the board body 10 for easy storage, and when the inflatable paddle board is taken to the beach or lake, the central balancing fin 20 is then assembled on the bottom of the hull portion 12 of the board body 10 before using.

Referring to FIGS. 2 to 4 and FIG. 22 of the drawings, the bottom surface 121 of the hull portion 12 of the board body 10 is a surface that will be immersed in the water of the sea or lake, and the bottom surface 121 of the hull portion 12 has a center position 122 which is a central position of the bottom surface 121. The center position 122 of the bottom surface 121 of the hull portion 12 is the exact central point of the length and width on the bottom surface 121 of the hull portion 12 and is located at the midpoint of both dimensions. This means that the center position 122 of the bottom surface 121 of the hull portion 12 is the point that is equidistant from both the front and rear sides, as well as from the left and right sides. Essentially, this point is found at the intersection of the lines that divide the length and the width of the boat into two substantial equal halves.

The central balancing fin 20 has a center line 201 which is perpendicular to a width of the central balancing fin 20 and is a vertical line that runs through the midpoint of the width of the central balancing fin 20. This center line 201 divides the central balancing fin 20 into two halves along its length. It starts at the midpoint of one edge and extends straight across to the midpoint of the opposite edge.

Figure 3:
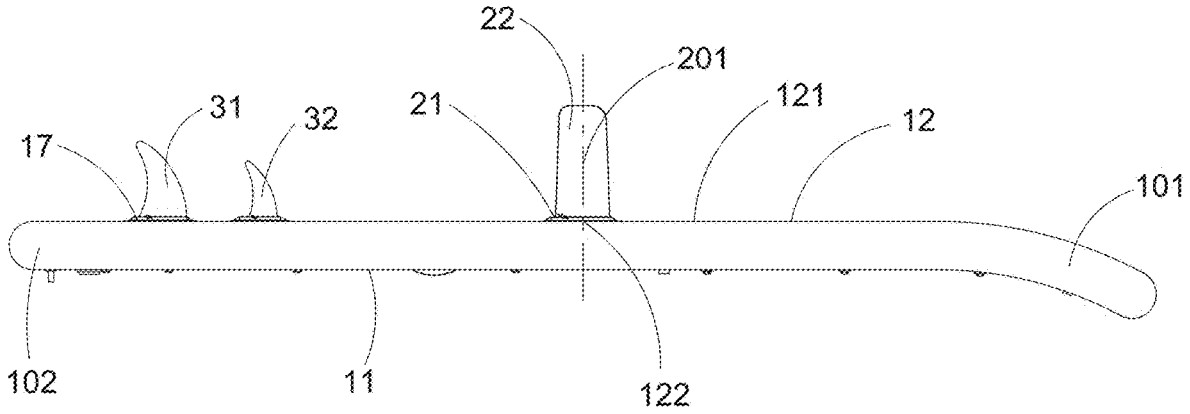
FIG. 3 is a sectional view illustrating the position of a central balancing fin on a bottom of a hull portion of a board body of the inflatable paddle board according to the above preferred embodiment of the present invention.

Preferably, in this embodiment, when the central balancing fin 20 is assembled on the bottom surface 121 of the hull portion 12, the center line 201 of the central balancing fin 20 is aligned with the center position 122 of the bottom surface 121 of the hull portion 12, as shown in FIG. 3 of the drawings, so that the central balancing fin 20 is located at a central area under the hull portion 12 to provide the enhanced balancing effect and to improve the navigation performance.

Figure 4:
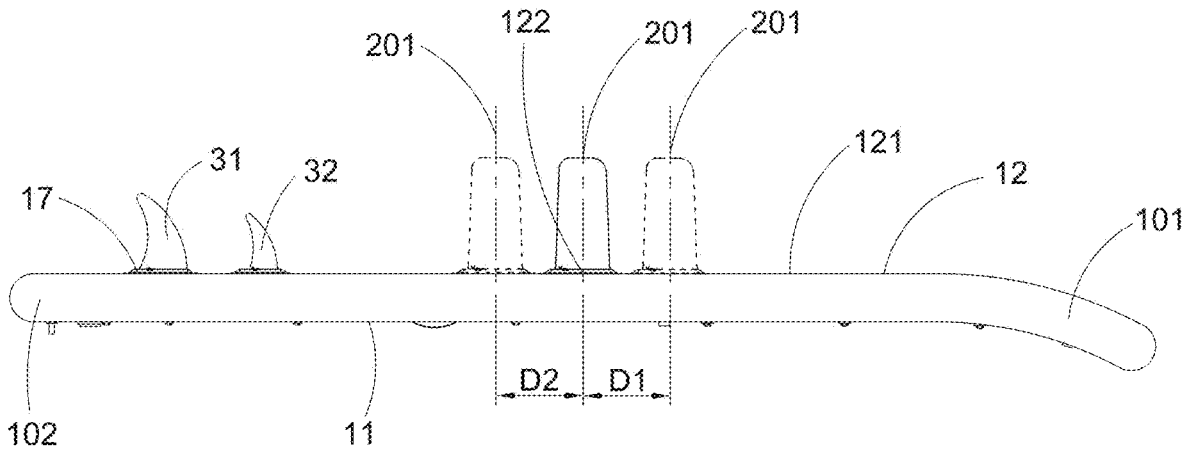
FIG. 4 is a sectional view illustrating the allowed deviated position of the central balancing fin on the bottom of the hull portion of a board body of the inflatable paddle board according to the above preferred embodiment of the present invention.

Referring to FIG. 4 of the drawings, the center line 201 of the central balancing fin 20 may be deviated from the center position 122 of the bottom surface 121 of the hull portion 12 with an allowable deviation distance along the length direction of the board body 10. As shown in the drawings, a forward deviation distance D1 is preferred to be within 30 cm and a backward deviation distance D2 is preferred to be within 50 cm, so as to adapt to different standing positions of the user on the deck portion 11 of the board body 10 and to maintain the center of gravity of the inflatable paddle board with the user on the board body 10 substantially at a center area thereof.

Preferably, the value of the allowable deviation distance on two directions in the present invention can be not more than 30 cm, more preferably not more than 10 cm. In other words, when the central balancing fin 20 is assembled on the bottom surface 121 of the hull portion 12, the distance between the center line 201 of the central balancing fin 20 and the center position 122 of the bottom surface 121 of the hull portion 12 is preferred to be not more than 10 cm, so as to ensure the balancing effect and navigation performance of the central balancing fin 20.

In this embodiment, the central balancing fin 20 is a plate which is able to increase the surface area of the inflatable paddle board in contact with the water, so as to provide an additional lateral resistance for enhancing the stability of the inflatable paddle board, and thus the inflatable paddle board in the water is not easy to tip over. The central balancing fin 20 also functions as a keel to reduce lateral drift, so as to help the inflatable paddle board to maintain a straight trajectory with reduced effort, unwanted constant correction by operation of the user is avoided.

Figure 23:
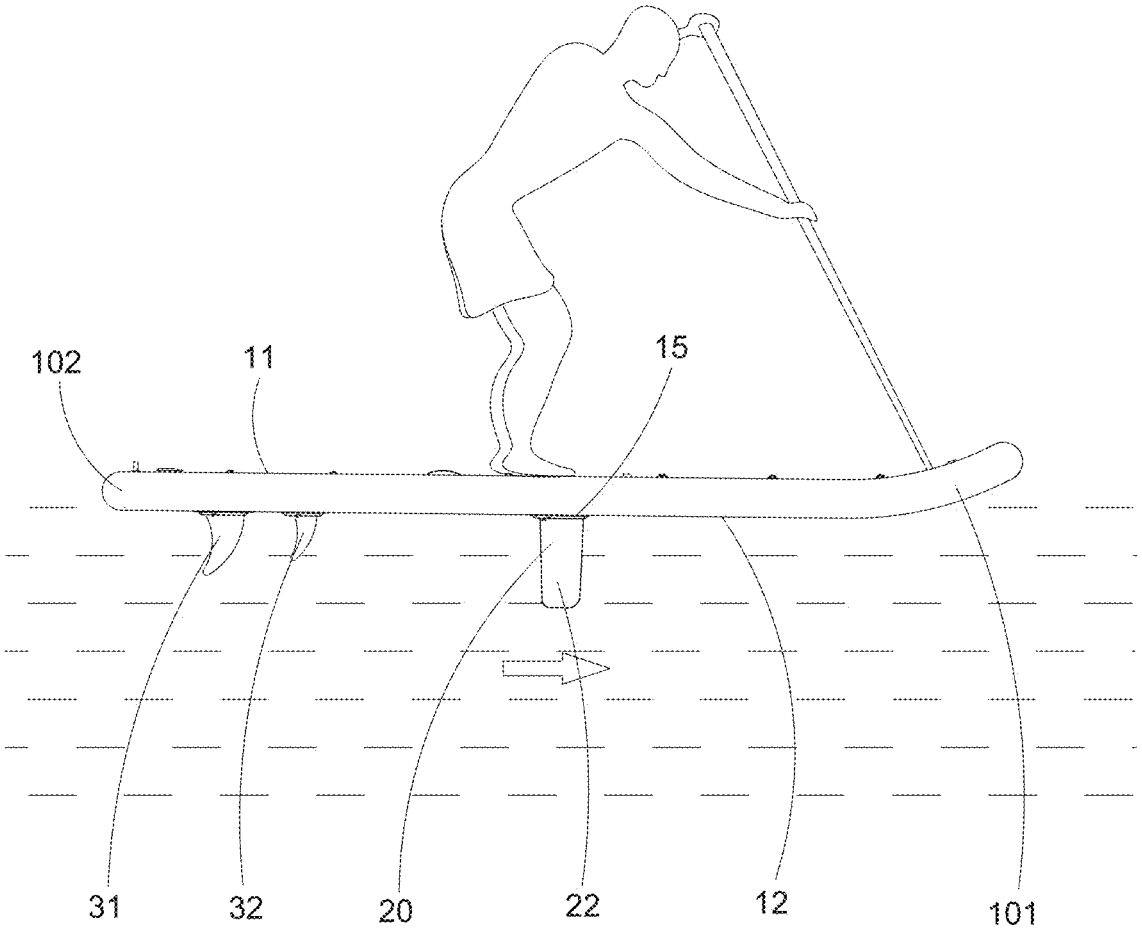
FIG. 23 is a perspective view illustrating a paddler standing on a central area of a deck portion of the board body of the inflatable paddle board according to the above preferred embodiment of the present invention.
Figure 24:
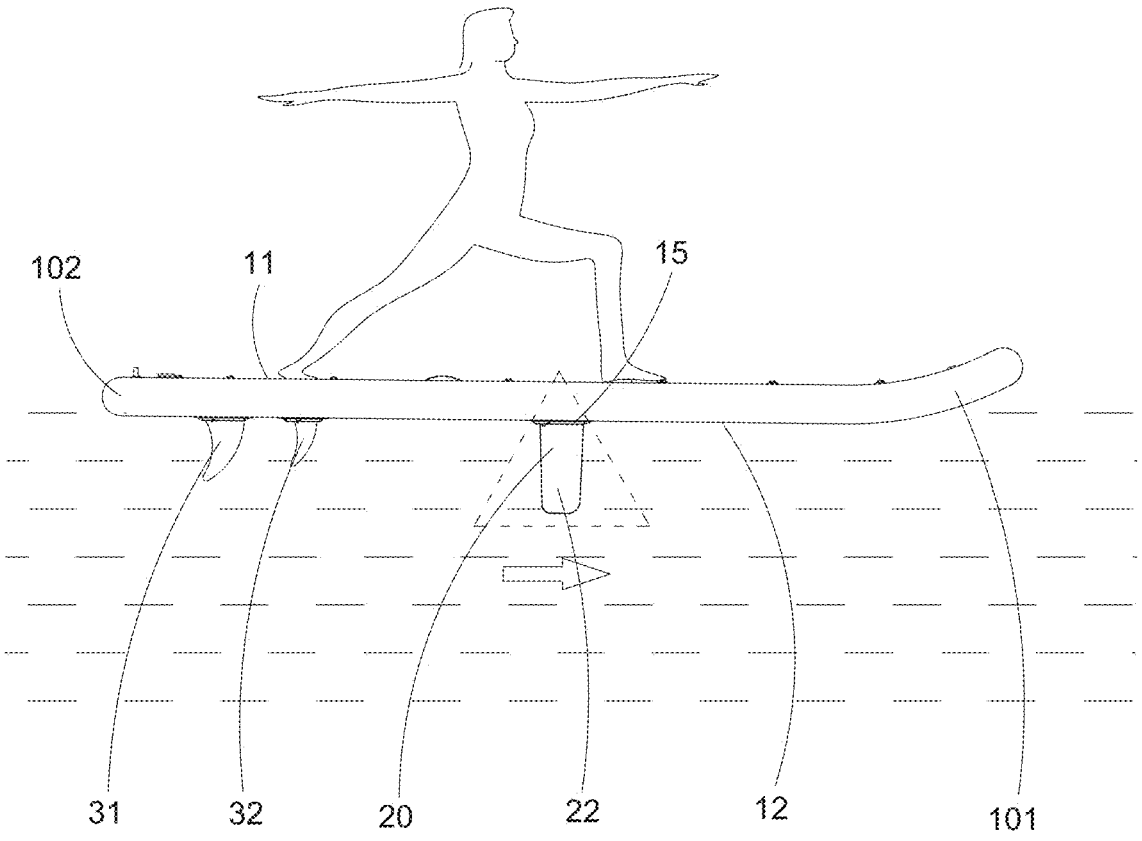
FIG. 24 is a perspective view illustrating a paddler standing on the board body of the inflatable paddle board in another standing posture according to the above preferred embodiment of the present invention.

In addition, when the user is standing on the deck portion 11 of the inflatable paddle board, the feet of the user often is at the center position of the top surface of the deck portion 11, so that the feet of the user is also adjacent to the central balancing fin 20. Accordingly, when the inflatable paddle board is encountering a water wave, a front end portion 101 of the board body 10 will be tend to float upward, and the central balancing fin 20 will act as a pivot point that allows the front end portion 101 of the board body 10 to move straight, as shown in FIGS. 23 to 25.

Figure 25:
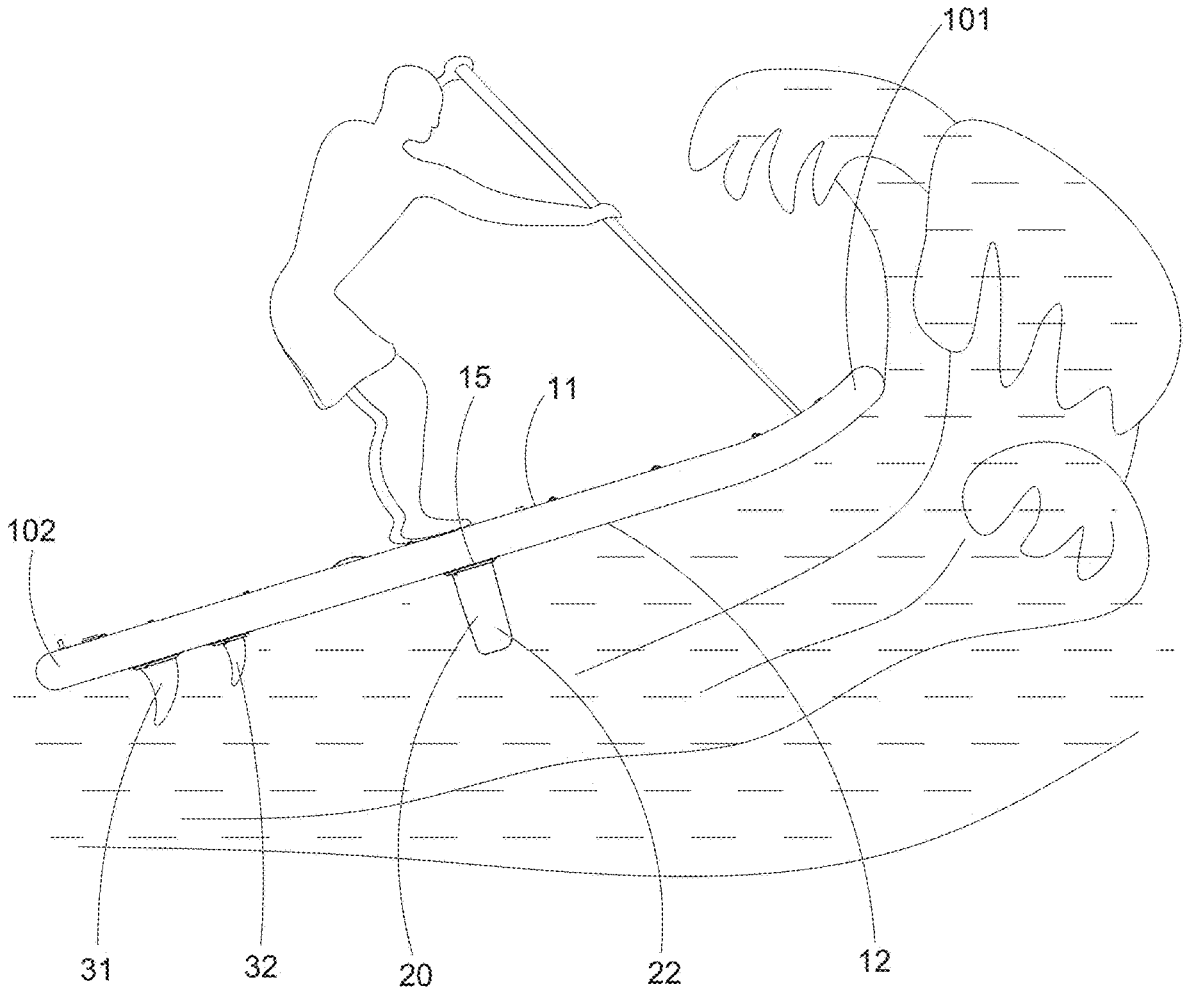
FIG. 25 is a perspective view illustrating the inflatable paddle board being encountered with a water wave according to the above preferred embodiment of the present invention.

In other words, with reference to FIG. 25, when navigating through waves, the front end portion 101 of the board body 10 tends to rise. This phenomenon occurs as the vessel encounters the crest of a wave, causing an upward force on the front end portion 101 of the board body 10. The increased buoyancy at the front end portion 101 of the board body 10 lifts it out of the water, which can be more pronounced in rough sea conditions or when the waves are large. The upward movement of the front end portion 101 of the board body 10 can cause significant pitching, where the front end portion 101 of the board body 10 rises and falls. This oscillatory motion can lead to discomfort for the user, and can also make the paddle board harder to control. As the front end portion 101 of the board body 10 lifts, the center of gravity of the board is tend to shift, potentially reducing overall stability, and this can make the board more prone to capsizing, especially if the movement is sudden or the waves are unpredictable. In addition, when the front end portion 101 of the board body 10 is elevated, the operation of the user may become less effective, and this can lead to difficulties in maintaining a straight course or responding quickly to steering inputs.

However, in the present invention, as shown in FIG. 25, the central balancing fin 20 which functions as the pivotal point under the paddle board 20 will prevent the pitching of the board body 10 in the wave, the user standing on the deck portion 11 will easy to manipulate the whole board body 10 and steer the board body 10 straight into the waves. More specifically, the central balancing fin 20 is employed as an anchor point to improve the directional control of the board body 10, so that the user can more easily steer and make precise adjustments to the heading of the paddle board. In addition, the center of gravity of the board body 10 is maintained because of the standing position of the user on the deck portion 11 and the central balancing fin 20 under the hull portion 12 of the paddle board, so as to enhance the stability of the board body 10 in the waves.

Any suitable material can be used for the central balancing fin 20. As an example, the central balancing fin 20 can be made of polypropylene which is a thermoplastic polymer and is produced through the polymerization of propylene gas. Polypropylene can offer good tensile strength and excellent resistance to repeated bending and flexing.

Polyamide also can be used for preparing the central balancing fin 20. Being in a family of synthetic polymers known for their high strength and durability, polyamide is extremely strong and durable, and with high tensile strength and impact resistance, so that the central balancing fin 20 is able to be frequently impacted by the water waves.

Another suitable material of the central balancing fin 20 is polycarbonate which is a strong, transparent thermoplastic with high impact resistance and optical clarity. With extremely high impact resistance, even at low temperatures, it can prevent cracking or breaking of the central balancing fin 20.

The central balancing fin 20 can be mounted to the bottom of the hull portion 12 with any suitable connecting manner. According to this embodiment, as shown in FIGS. 5 to 8 of the drawings, the paddle board 10 further comprises a fixing holder 15 for detachably assembling the central balancing fin 20.

More specifically, the fixing holder 15 is permanently fixed on the bottom surface 121 of the hull portion 12 and is embodied to comprise a holding body 151 and a fixing plate 152. The holding body 151 is integrally extended from the fixing plate 152 for detachably engaging with the central balancing fin 20. The fixing plate 152 is fixed to the bottom surface 121 of the hull portion 12. For example, the fixing plate 152 can be adhered to the bottom surface 121 of the hull portion 12 by a glue. In other example, the fixing plate 152 can be connected to the bottom surface 121 of the hull portion 12 by one or more connectors such as rivets and screw connecting members.

Figure 9:
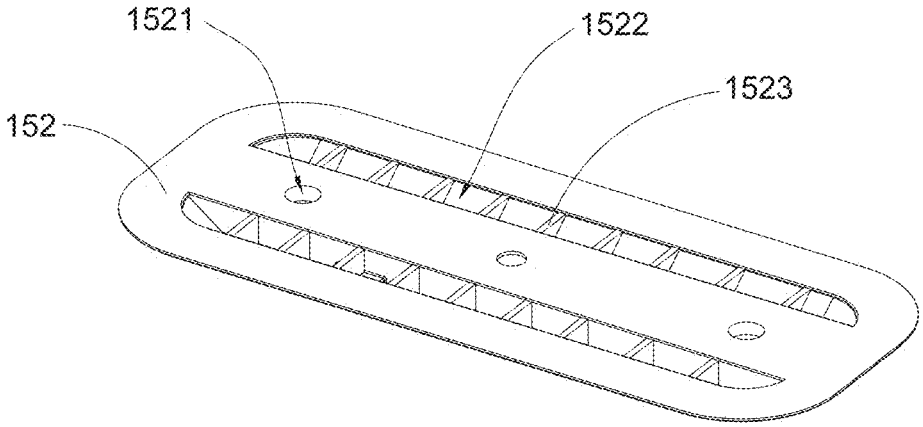
FIG. 9 is a perspective view illustrating a bottom structure of a fixing plate of the fixing holder of the inflatable paddle board according to the above preferred embodiment of the present invention.

As shown in FIG. 9 of the drawings, according to this embodiment, the fixing plate 152 is fixed to the bottom surface 121 of the hull portion 12 by ultrasonic welding which is a process involves using high-frequency ultrasonic acoustic vibrations to create solid-state welds between materials of the fixing plate 152 and the hull portion 12. The materials to be welded are placed together under pressure, and the ultrasonic vibrations are applied to the fixing plate 152 and the hull portion 12, causing friction and generating heat that fuses them together. The fixing plate 152 has one or more positioning hole 1521 which are used to provide positioning function during the ultrasonic welding process.

The fixing plate 152 has two bottom grooves 1522 provided at two opposite sides of the line of the positioning holes 1521, and a plurality of reinforcing ribs 1523 is provided in each corresponding bottom groove 1522 to enhance the strength of the fixing plate 152.

The holding body 151 has a holding channel 1511, an upper groove 1512 communicated to the holding channel 1511, a retention groove 1513 which is intersected with the upper groove 1512. The holding channel 1511 and the upper groove 1512 are both elongated in shape and extended along a length of the holding body 151. The retention groove 1513 is a transverse groove that is along a width of the holding body 151 and comprises two recessed grooves 15131 formed at two opposite sides of the upper groove 1512. The holding body 151 further has an exit opening 1514 which is communicated to the holding channel 1511.

The central balancing fin 20 comprises an assembling base 21 and a fin body 22 connected to the assembling base 21. The assembling base 21 is configured to be shaped and sized to couple with the holding channel 1511 of the holding body 151 and can be detachably mounted to the holding channel 1511 of the holding body 151, so as to assemble the central balancing fin 20 on the fixing holder 15.

As shown in FIGS. 5 to 8 of the drawings, the assembling base 21 comprises a base body portion 211 and a retention portion 212 extended from the base body portion 211, the fin body 22 is integrally and vertically extended from the retention portion 212. The assembling base 21 further has a retention hole 213 formed in the retention portion 212. In this embodiment, the retention hole 213 is formed between a bottom of the fin body 22 and the retention portion 212. Alternatively, the retention hole 213 can be a hole penetrating only through the retention portion 212. When the assembling base 21 is assembled on the fixing holder 15, the retention hole 213 is aligned with the retention groove 1513 to form an integral penetrating channel with two recessed grooves 15131 communicated to the retention hole 213 and arranged at two opposite sides of the retention hole 213.

The board body 10 further comprises a retention pin 16 which can be inserted through the integral penetrating channel formed by the retention groove 1513 of the holding body 151 and the retention hole 213 of the assembling base 21, so as to fix the central balancing fin 20 to the fixing holder 15 of the board body 10.

Figure 8:
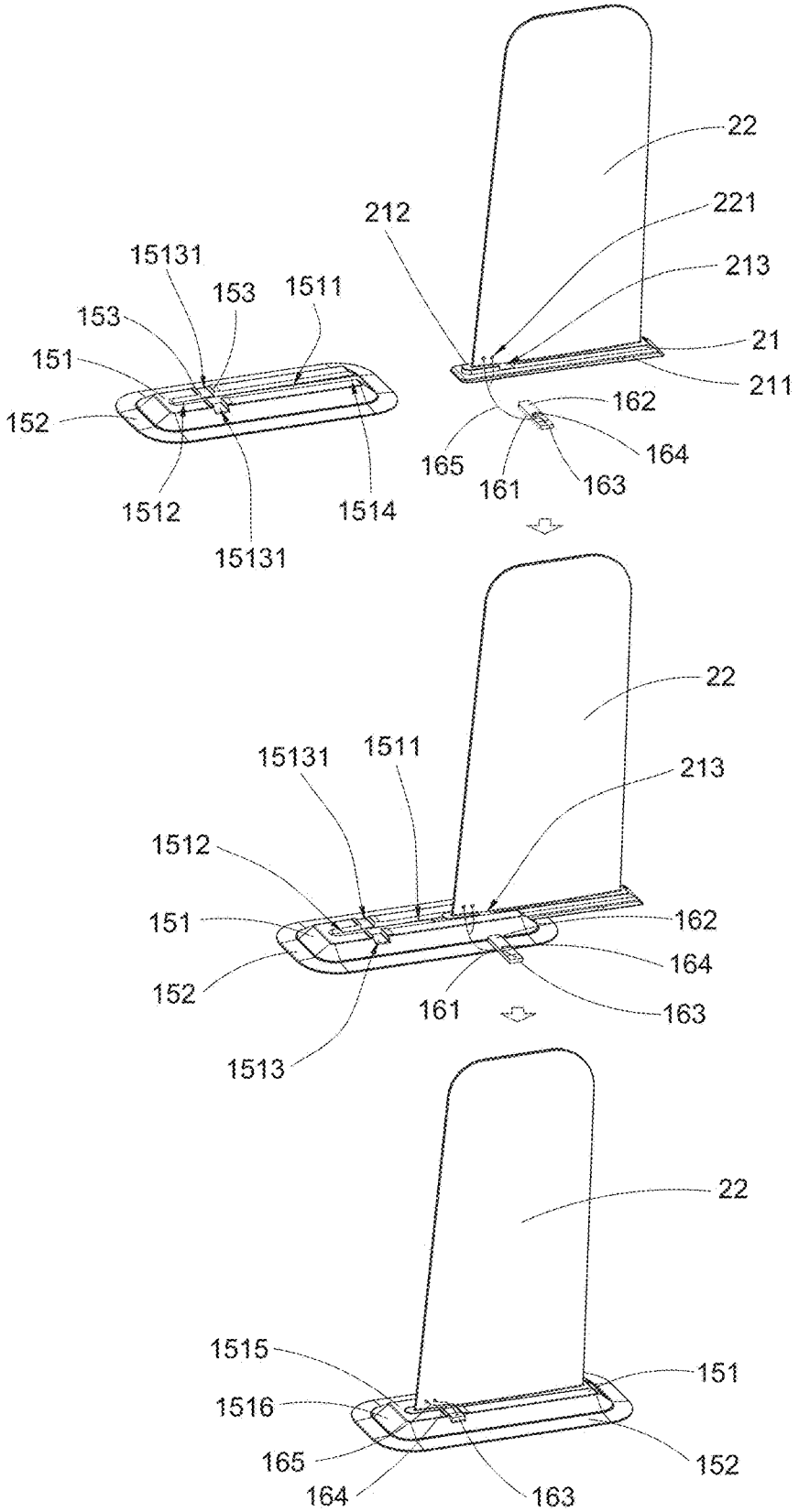
FIG. 8 is a perspective view illustrating the assembling process of the central balancing fin on the fixing holder of the inflatable paddle board according to the above preferred embodiment of the present invention.

Referring to FIG. 8 of the drawings, when assembling the central balancing fin 20 to the fixing holder 15 on the bottom surface 121 of the hull portion 12, the central balancing fin 20 is placed at a position to align the base body portion 211 with the holding channel 1511 of the holding body 151, and then the base body portion 211 of the assembling base 21 is slid into the holding channel 1511 of the holding body 151 at an end of the holding body 151 through the exit opening 1514 which is communicated to the holding channel 1511, so as to align the retention hole 213 of the assembling base 21 with the retention groove 1513 of the holding body 151. In this embodiment, the retention portion 212 is slid into the upper groove 1512 until an end 2121 of the retention portion 212 is biasing against an end wall of the upper groove 1512, so that the alignment between the retention hole 213 of the assembling base 21 with the retention groove 1513 of the holding body 151 can be ensured, and the retention portion 212 is firmly retained in the upper groove 1512.

After the assembling base 21 is mounted to the fixing holder 15, the retention pin 16 is inserted to penetrate through the retention groove 1513 of the holding body 151 and the retention hole 213 of the assembling base 21 until two end portions of the retention pin 16 are respectively seated in the two recessed groove 15131, so that the central balancing fin 20 is firmly secured on the fixing holder 15 of the board body 10.

In this embodiment, the retention pin 16 comprises a pin body 161, an inserting end portion 162, an enlarged operation portion 163, and a biasing portion 164 protruded from the pin body 161. The inserting end portion 162 is adapted for being firstly inserted into the integral penetrating channel formed by the retention hole 213 of the assembling base 21 and the retention groove 1513 of the holding body 151, so as to further guide the movement of the rest portions of the retention pin 16 within the integral penetrating channel. The enlarged operation portion 163 has at least a part that is protruded from the pin body 161, so as to facilitate the user to use his or her fingers of grip the enlarged operation portion 163 to pull the retention pin 16 out of the central balancing fin 20 and the fixing holder 15. The biasing portion 164 is biasing against a side wall of the fin body 22 of the central balancing fin 20 so as to block the further movement of the retention pin 16 when the retention pin 16 is inserted into the integral penetrating channel formed by the retention hole 213 of the assembling base 21 and the retention groove 1513 of the holding body 151.

The pin body 161 is shaped and sized to couple with the retention hole 213 of the assembling base 21 and the retention groove 1513 of the holding body 151, so as to firmly retain the retention pin 16 within the retention hole 213 of the assembling base 21 and the retention groove 1513 of the holding body 151. Preferably, the pin body 161 is interference fitting with the retention hole 213 of the assembling base 21 and the retention groove 1513 of the holding body 151, so that the retention pin 16 is not easy to slip off form the retention hole 213 of the assembling base 21 and the retention groove 1513 of the holding body 151.

Alternatively, the integral penetrating channel formed by the retention hole 213 of the assembling base 21 and the retention groove 1513 of the holding body 151 is configured to have a gradually reducing width, and the corresponding pin 16 can be configured to have a gradually reducing width from the enlarged operation portion 163 to the inserting end portion 162. When the retention pin 16 is inserted into the integral penetrating channel, the inserting end portion 162 of the retention pin 16 will penetrate through the retention hole 213 of the assembling base 21 until the inserting end portion 162 of the retention pin 16 is stopped at a suitable secure assembling position.

Alternatively, the pin body 161 is shaped and sized to couple with the retention hole 213 of the assembling base 21 and the retention groove 1513 of the holding body 151 while the enlarged operation portion 163 of the retention pin 16 is interference fitting with the retention hole 213 of the assembling base 21 and the retention groove 1513 of the holding body 151.

Figure 7:
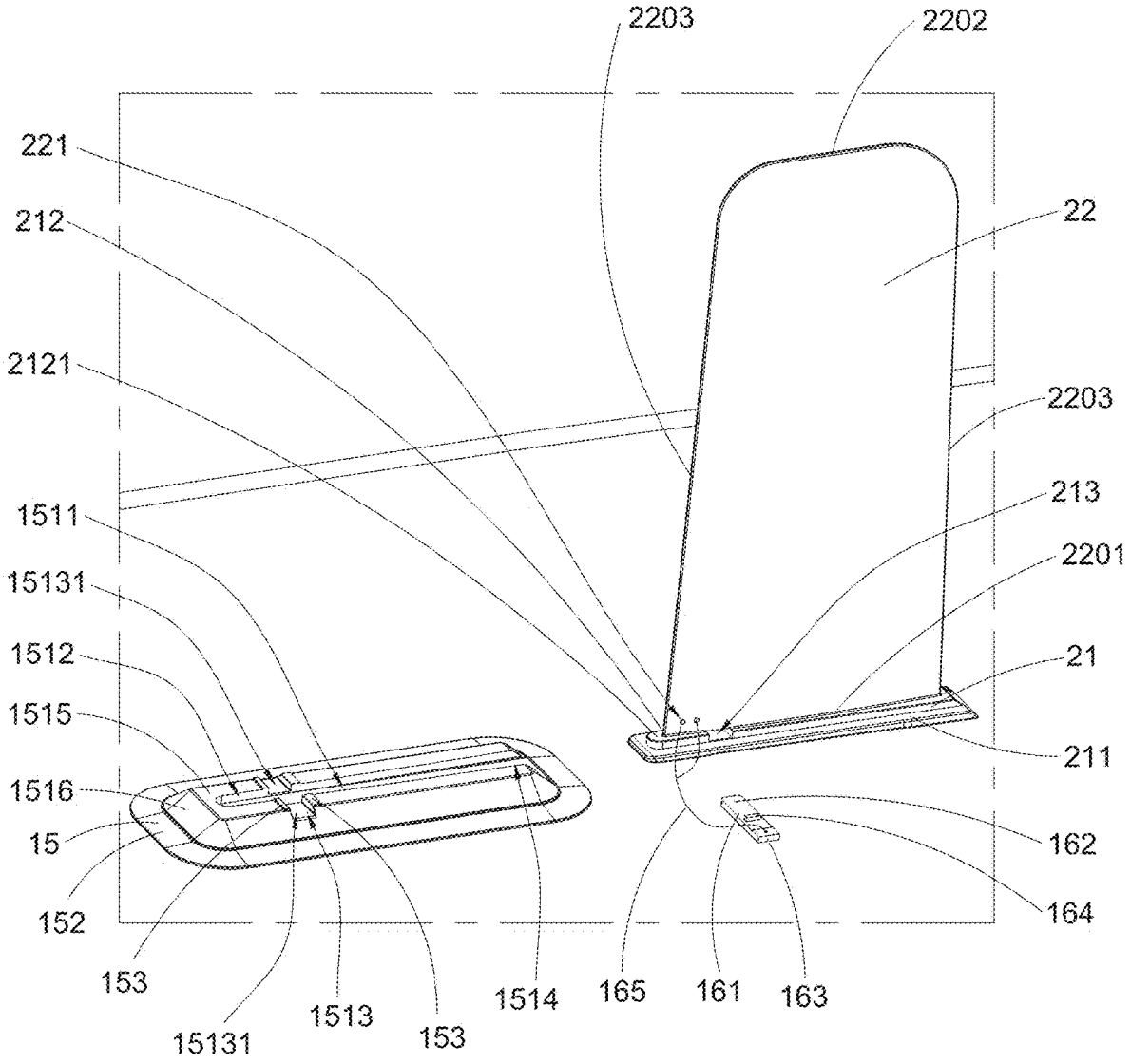
FIG. 7 is a partial enlarged view of an area B of FIG. 6 for illustrating the coupling manner between the central balancing fin and the fixing holder of the inflatable paddle board according to the above preferred embodiment of the present invention.

As shown in FIG. 7 and FIG. 8 of the drawings, the retention pin 16 further comprises a connecting rope 165 connected to the enlarged operation portion 163, the fin body 22 has one or more connecting holes 221 such as two connecting holes 221, the connecting rope 165 is connected to the fin body 22 by having an end portion passing through the two connecting holes 221 before being tied up. Accordingly, the retention pin 16 is then attached to the fin body 22, and will not be easy to be missing when the retention pin 16 is detached from the fixing holder 15 and the assembling base 21.

Figure 10:
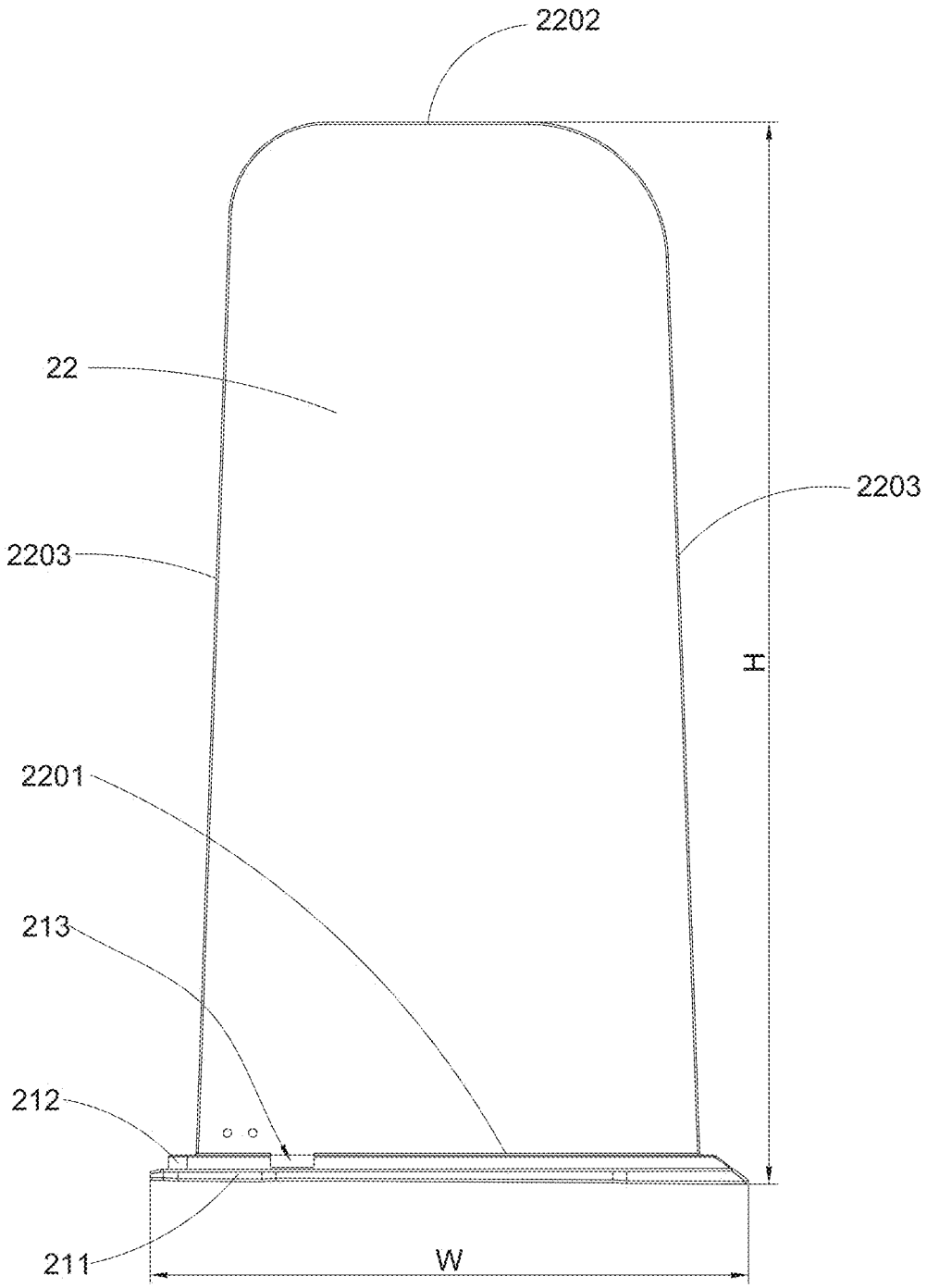
FIG. 10 a sectional view illustrating the central balancing fin of the inflatable paddle board according to the above preferred embodiment of the present invention.
Figure 11:
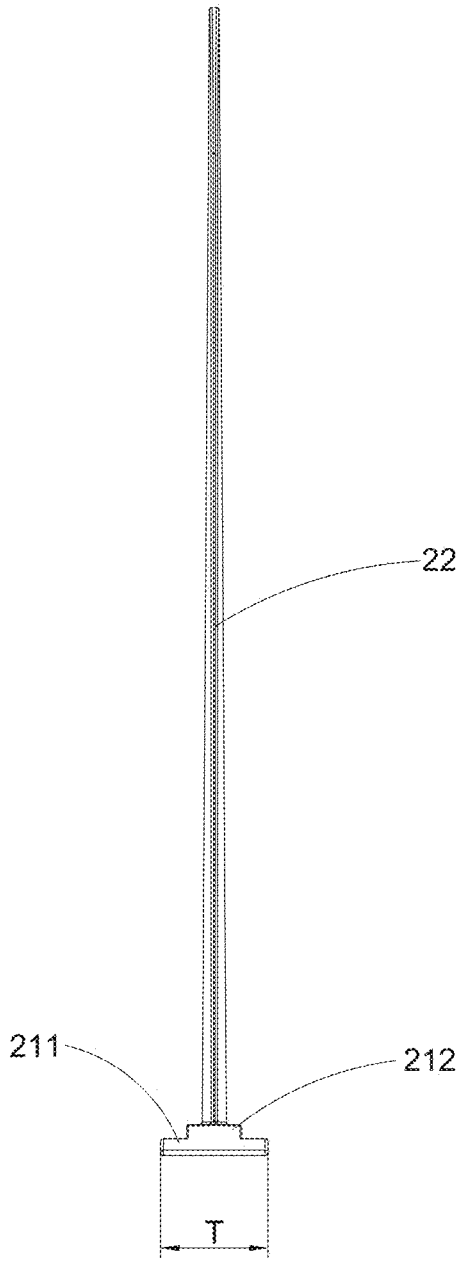
FIG. 11 a cross-sectional view illustrating the central balancing fin of the inflatable paddle board according to the above preferred embodiment of the present invention.

The shape and size of the central balancing fin 20 is not limited in the present invention. Preferably, the central balancing fin 20 is constructed with a configuration shown in FIGS. 5, 7 and 10-11 of the drawings. The central balancing fin 20 is preferred to have a height H that is ranged from 150 mm-500 mm, a width W that is ranged from 100 mm-400 mm. As shown in FIGS. 10 and 11 of the drawings, as an example, the height H of the central balancing fin 20 is 380 mm, the width of the central balancing fin 20 is 214 mm.

As shown in FIG. 11 of the drawings, the fin body 22 of the central balancing fin 20 is preferred to have a gradually increasing thickness T from a top end to a bottom end, a maximum thickness of the fin body 22 is preferred to be 3 mm-30 mm. A thickness of the base body portion 211 of the assembling base is preferred to be ranged from 10 mm-50 mm.

Figure 12:
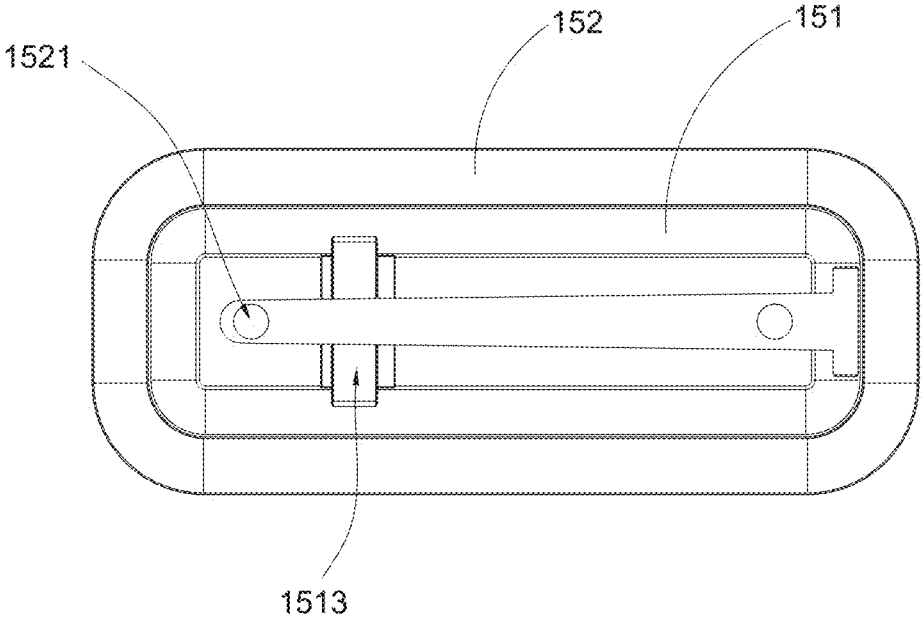
FIG. 12 a top view illustrating the fixing holder of the inflatable paddle board according to the above preferred embodiment of the present invention.
Figure 13:
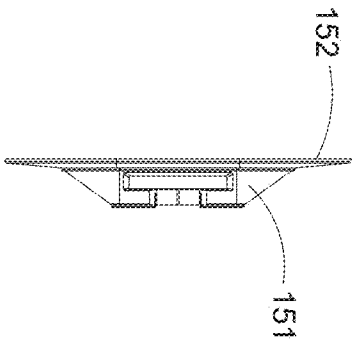
FIG. 13 a cross-sectional view illustrating the fixing holder of the inflatable paddle board according to the above preferred embodiment of the present invention.

Referring to FIGS. 12 to 13 of the drawings, a length of the fixing holder 15 is preferred to be ranged from 150 mm-450 mm, a width of the fixing holder 15 is preferred to be ranged from 50 mm-150 mm, a height of the fixing holder 15 is preferred to be ranged from 5 mm-30 mm. As an example of this embodiment, the length of the fixing holder 15 is 272 mm, a width of the fixing holder 15 is 114, a height of the fixing holder 15 is 16 mm.

Figure 5:
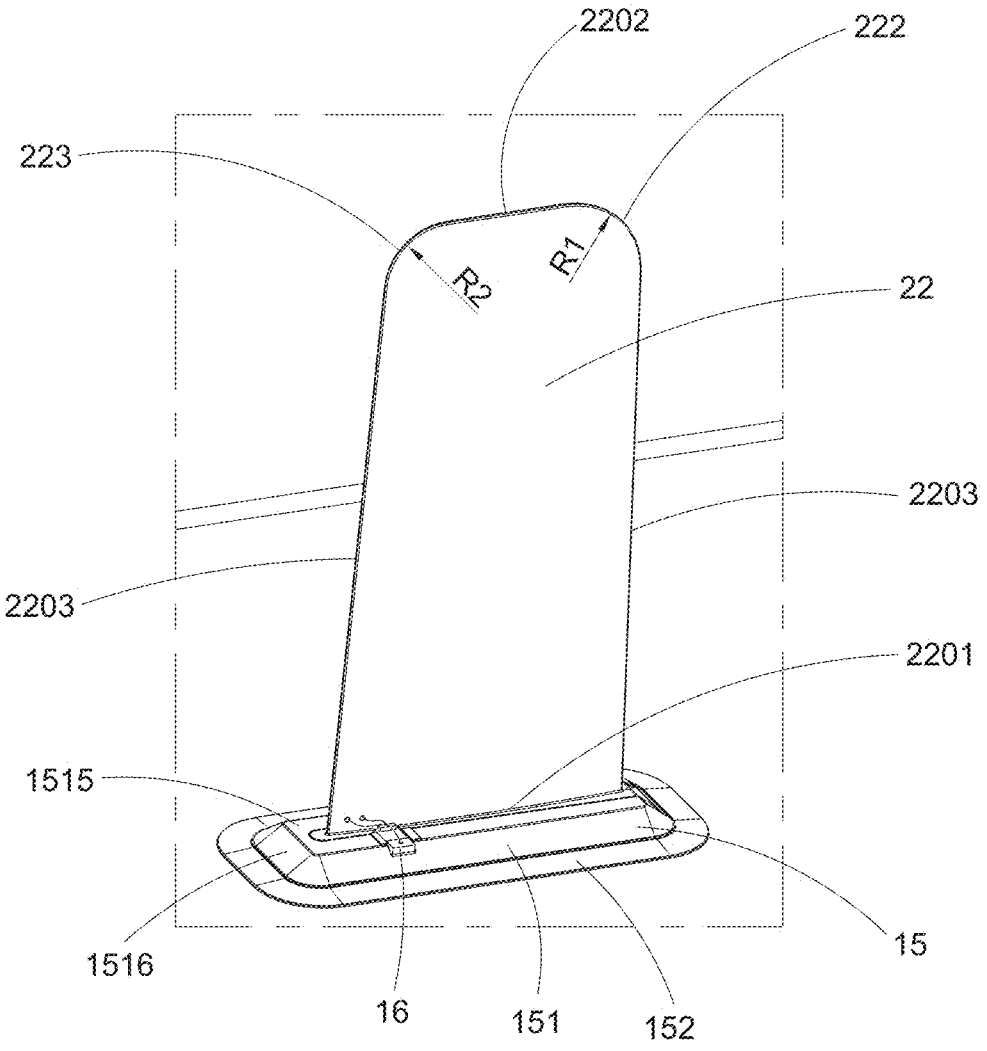
FIG. 5 is a partial enlarged view of an area A of FIG. 2 for illustrating the central balancing fin and a fixing holder of the inflatable paddle board according to the above preferred embodiment of the present invention.
Figure 6:
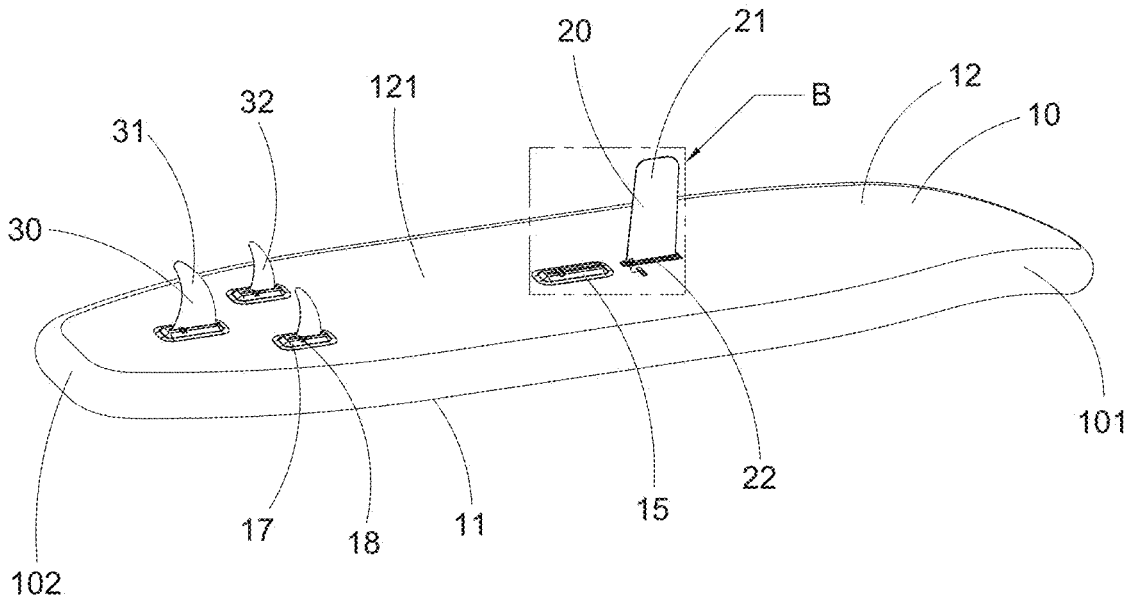
FIG. 6 is a perspective view illustrating a detachable mounting manner between the central balancing fin and the fixing holder of the inflatable paddle board according to the above preferred embodiment of the present invention.

In the FIGS. 5, 7 and 10 of the drawings, the fin body 22 is shown to have a trapezoid shape and comprise a bottom long edge 2201, a top short edge 2202 and two inclined side edges 2203 extended between the bottom long edge 2201 and the top short ledge 2202. The person of ordinary skilled in the art should understand the fin body 22 also can be configured in other shapes, such as a square shape, a triangular shape, a rectangular shape, a semi-circular shape.

According to this embodiment, the fin body 22 comprises a front corner portion 222 and a rear corner portion 223 at an end part thereof, the front corner portion 222 has a front arc edge 2221, and the rear corner portion 223 has a rear arc edge 2231, the arc edges of the corner portions can help to reduce the frictional drag between the hull portion 12 and the water. This is because they can guide the flowing water around the central balancing fin 20, thereby reducing the formation of vortices which are a type of turbulent flow that can increase drag as well as reducing the noise generated by the board body 10.

In addition, the front arc edge 2221 has a front corner radii R1 which is larger than a rear corner radii R2 of the rear arc edge 2231. The front arc edge 2221 has the larger corner radii so shat the front corner portion 222 can help to increase the lift of the hull portion 12. This is because it can increase the effective area at the front side which generates more lift. Lift can help to overcome the weight of the paddle board body 10, thereby increasing board speed. The front corner portion 222 with the larger corner radii is also beneficial as it can help to improve the maneuverability of the board body 10 by generating more lateral driving forces at the front side of the board body 10, so as to help the board body 10 turn and maintain course.

Referring to FIGS. 5 and 7 of the drawings, the holding body 151 has a top surface 1515 and a surrounding wall 1516 extended between the fixing plate 152 and the top surface 1515 of the holding body 151. The upper groove 1512 is formed along the top surface 1515 of the holding body 151. The surrounding wall 1516 is curvedly or inclinedly extended from the fixing plate 152, so as to evenly distribute the impact force from the fin body 22 of the central balancing fin 20 towards the hull portion 12 of the board body 10 through the fixing base 152.

As shown in FIG. 7 of the drawings, it is worth mentioning that the fixing holder 15 further comprises two pairs of protrusion steps 153 which are protruded from the top surface 1515 of the holding body 151. Each of the two pairs of protrusion steps 153 comprises two protrusion steps 153 which are respectively formed at two opposite sides of the corresponding recessed groove 15131.

The raised protrusion steps 153 on both sides of the corresponding recessed groove 15131 increase the lateral resistance to the retention pin 16 when it is inserted into the retention groove 1513 and is blocked by the protrusion steps 153. This design feature enhances the stability and security of the retention pin 16 within the recessed grooves 15131 of the retention groove 1513. By increasing the lateral resistance, the raised protrusion steps 153 prevent the retention pin 16 from easily dislodging or shifting, which is particularly advantageous in the assembling of the central balancing fin 20 where maintaining a secure and stable connection is crucial. This added resistance ensures that the retention pin 16 remains firmly in place, reducing the likelihood of accidental disengagement or loosening, thereby increasing the overall reliability and safety of the assembly.

In other words, the raised protrusion steps 153 on both sides of the retention groove 1513 act as barriers that increase the frictional force and resistance against lateral movement of the retention pin 16. This feature is particularly beneficial for the inflatable paddle board because the central balancing fin 20 will be likely to be impacted by the water waves to cause the retention pin 16 to become loose or dislodged. The enhanced stability ensures that the connection remains intact under various impact conditions, contributing to the overall durability and reliability of the assembly between the central balancing fin 20 and the board body 10.

In addition, a smaller height difference between the retention pin 16 and the surrounding surface of the fixing holder 15 will create a sleeker and more streamlined look. This contributes to a cleaner, more refined aesthetic of the inflatable paddle board. A more visually appealing design can enhance the perceived quality and craftsmanship of the product, making it more attractive to consumers and users.

Figure 17:
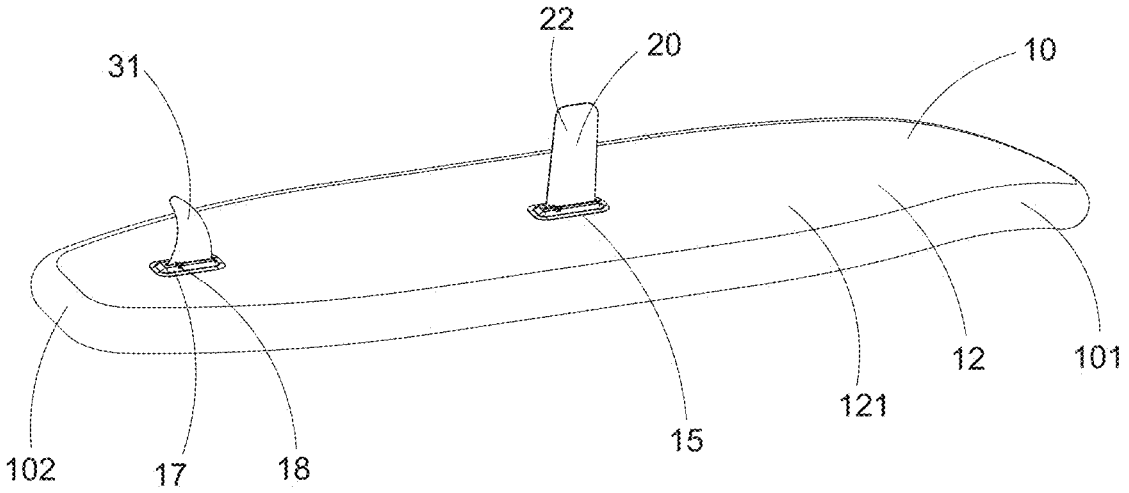
FIG. 17 is a perspective view illustrating of an inflatable paddle board according to a first alternative mode of the above preferred embodiment of the present invention.

Referring to FIGS. 2-6 of the drawings, the inflatable paddle board further comprises one or more rear fins 30 provided at a bottom of the rear end portion 102 of the board body 10, so as to further ensure the straight navigation of the paddle board and enhance the stability of the paddle board. According to this embodiment, the one or more rear fins 30 may comprise a first central rear fin 31 which is aligned with the central balancing fin 20. In other words, the bottom surface 121 of the hull portion 12 has a central line X along the length of the hull portion 12, the first central rear fin 31 and the central balancing fin 20 are arranged in the same central line X. As shown in FIG. 17 of the drawings, the inflatable paddle board may comprise a single rear fin which is the first central rear fin 31.

The central balancing fin 20 and the first central rear fin 31 are able to provide a significant increase in directional stability, making the board body 10 more resistant to changes in course. This is particularly beneficial in rough seas or when making sharp turns. The two fins 20 and 31 can improve the maneuverability of the board body 10, this is because they provide a more effective means of controlling the direction. By sharing the steering load between the central balancing fin 20 and the first central rear fin 31, it is able to reduce wear and tear on the fin system. This can extend the lifespan of the fins and other steering components.

In addition, because the central balancing fin 20 and the first central rear fin 31 are typically arranged in line with each other, so that they provide two pivot points in a same line that help to prevent the board body from rolling, rotating or yawing excessively. In other words, when there is only one pivot point, when the board body 10 is starting to rotate in the water, the rotating movement of the board body 10 about the single pivot point may be difficult to be stopped. However, when there are two pivot points in the same line, the rotating movement with respect to one pivot point will be hindered because of the existence of the other pivot point.

The one or more rear fins 30 may comprise two second rear fins 32 which are symmetrically distributed at the bottom of the rear end portion 102 of the board body 10 on two opposite sides of the central line X along the length of the hull portion 12. The design of the central balancing fin 20 at the front and two symmetrical second rear fins 32 at the rear end portion 102 of the board body 10 of the inflatable paddle board provides three stable points of support, and this configuration significantly prevents excessive rotational movement of the board body 10.

The three-point support system distributes the forces acting on the board body 10 more evenly, reducing the risk of tipping over. This is especially beneficial in choppy waters or when encountering waves, ensuring the board body 10 remains stable and the paddler secure.

The central front balancing fin 20 acts as a guide, helping to maintain a straight line while paddling. The two second rear fins 32 provide additional support, minimizing lateral movements and swaying. This combination ensures smoother navigation and easier control of the direction of the board body 10. While the central balancing fin 20 and the two second rear fins 32 stabilize the board body 10, they also allow for agile turns and adjustments. The symmetrical second rear fins 32 enable quick and precise directional changes without compromising stability, making the board body 10 responsive to the paddler's movements.

In addition, with improved stability and tracking, the paddler can maintain his or her course with less effort, reducing fatigue over longer distances. This makes the inflatable paddle board more enjoyable and accessible for paddlers of all skill levels.

Furthermore, the minimized risk of capsizing and improved control contribute to a safer paddling experience. The paddler can focus on his or her technique and the surrounding environment without constant concern about losing balance.

The person of ordinary skilled in the art should understand that the one or more rear fins 30 may comprise only a single rear fin which is the first central rear fin 31, or may comprise the two second rear fins 32, or may comprise three or more rear fins 30 including the first central rear fin 31 and the two second rear fins 32.

The one or more rear fins 30 are also preferred to be detachably mounted to the bottom surface 121 of the hull portion 12 of the board body 10. Correspondingly, the board body 10 further comprises one or more rear fixing holders 17 for detachably assembling the one or more rear fins 30, and one or more rear retention pins 18 for retaining the one or more rear fins 30 on the corresponding one or more rear fixing holders 17.

Each of the rear fixing holders 17 can be embodied to have a structure similar to the above fixing holder 15, and each of the rear retention pins 18 can be embodied to have a structure similar to the above retention pin 16, and thus the structures of the rear fixing holders 17 and the rear retention pins 18 will not be described in details.

Figure 14:
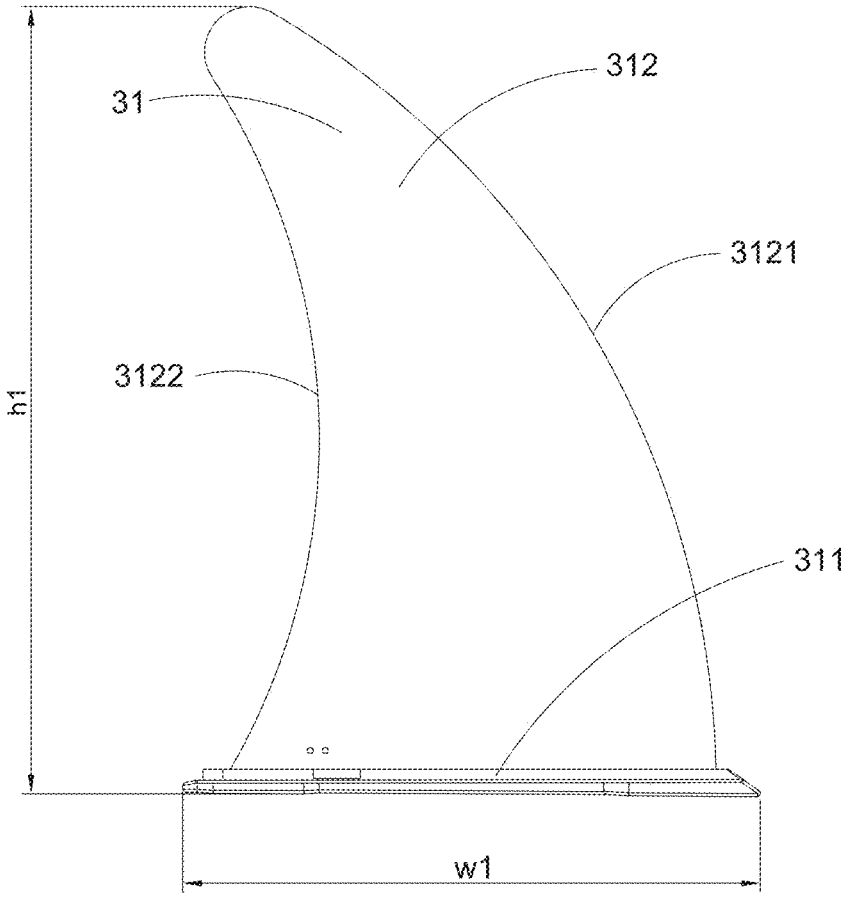
FIG. 14 a sectional view illustrating a first central rear fin of the inflatable paddle board according to the above preferred embodiment of the present invention.

With reference to FIG. 14 of the drawings, the first central rear fin 31 comprises a first rear assembling base 311 and a first rear fin body 312 extended from the first rear assembling base 311. In this embodiment, a size of the first rear fin body 312 of the first central rear fin 31 is smaller than a size of the fin body 22 of the central balancing fin 20. In other words, an area, a width, a height and a thickness of the first rear fin body 312 is smaller than a an area, a width, a height and a thickness of the fin body 22 of the central balancing fin 20.

Figure 16A:
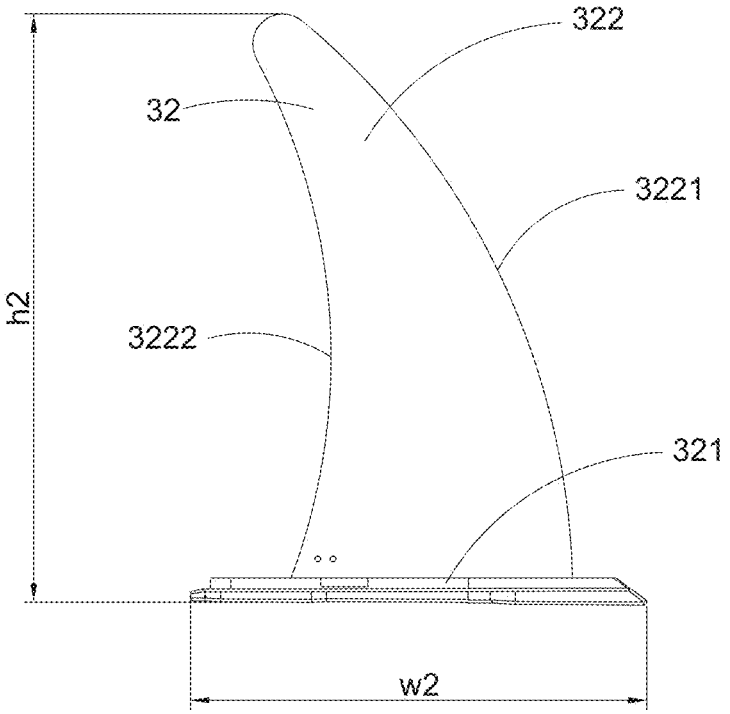
FIG. 16A a sectional view illustrating a second rear fin of the inflatable paddle board according to the above preferred embodiment of the present invention.

As shown in FIG. 16A, each of the second rear fins 32 comprises a second rear assembling base 321 and a second rear fin body 322 extended from the second rear assembling base 321, a size of each of the second rear fin body 322 is preferred to be smaller than the size of the first rear fin body 312 of the first central rear fin 31 and the size of the fin body 22 of the central balancing fin 20

Accordingly, the larger front central balancing fin 20 acts as a primary stabilizer, helping to maintain a straight course.

Its increased size ensures better tracking, reducing the need for constant adjustments by the paddler. This is particularly beneficial in maintaining stability in various water conditions, including currents and waves.

The greater surface area and dimensions of the front central balancing fin 20 provide a stronger grip on the water. This allows for more precise control over the direction of the paddle board. The paddler can execute smoother and more controlled turns, enhancing overall maneuverability without sacrificing stability. Since the front central balancing fin 20 has a lager dimension, the substantial size of the front central balancing fin 20 provides a pivot point that enhances stability during turns. In other words, rather than the rear fins 31 or 32, the front central balancing fin 20 will function as the pivot point for the paddler to manipulate the navigation of the paddle board, this makes the paddle board more responsive to the steering operation of the paddler, allowing for sharper and more controlled turns without the risk of tipping over.

The increased height and thickness of the front central balancing fin 20 minimize lateral drift, keeping the paddle board on a straight path. This feature is especially useful for long-distance paddling, where maintaining a straight line is crucial for efficiency and reducing fatigue.

The combination of a larger front central balancing fin 20 and smaller first central rear fin 31 or second rear fins 32 offers a balanced performance. The rear fins 31 or 32 contribute to stability and support without adding excessive drag. This balance allows for optimal speed and maneuverability, making the paddle board suitable for various activities, from leisurely paddling to more dynamic movements.

As shown in FIG. 14 of the drawings, the first rear fin body 312 is constructed to has a first streamlined front curve edge 3121 and a first arched rear curve edge 3122. As shown in FIG. 16A of the drawings, the second rear fin body 322 is constructed to has a second streamlined front curve edge 3221 and a second arched rear curve edge 3222. The fish-shaped fin with its two curved edges optimizes the hydrodynamics, stability, and control of the paddle board, offering a superior paddling experience.

More specifically, the streamlined front curve reduces water resistance, allowing for smoother and more efficient movement through the water. This design minimizes drag, enabling the paddler to glide effortlessly, thereby conserving energy and increasing overall speed.

The arched rear curve provides a stable anchor point, offering better control and balance. This design helps to maintain a straight trajectory and reduces unwanted lateral movements, so that the paddler can navigate more precisely, making it easier to stay on course and execute turns with greater accuracy.

The combination of the streamlined front and arched rear curves allows for a balanced trade-off between stability and agility. The paddler can make quick adjustments and turns without compromising stability. The smooth transition from the streamlined front curve to the arched rear curve minimizes turbulence and water disruption. This leads to a quieter and more stable ride, improving the paddling experience, especially in calm waters.

In addition, the fish-shaped fin adds a visually appealing element to the paddle board. Its unique design can attract enthusiasts who appreciate both form and function, enhancing the overall attractiveness of the inflatable paddle board of the present invention.

The person of ordinary skilled in the art should understand that the shape and size of the first central rear fin 31 is not limited in the present invention. According to this embodiment, the first central rear fin 31 is preferred to have a height h1 that is ranged from 100 mm-300 mm, a width w1 that is ranged from 100 mm-200 mm. As shown in FIG. 14 of the drawings, as an example, the height h1 of the first central rear fin 31 is 218 mm, the width of the first central rear fin 31 is 181 mm.

Figure 15:
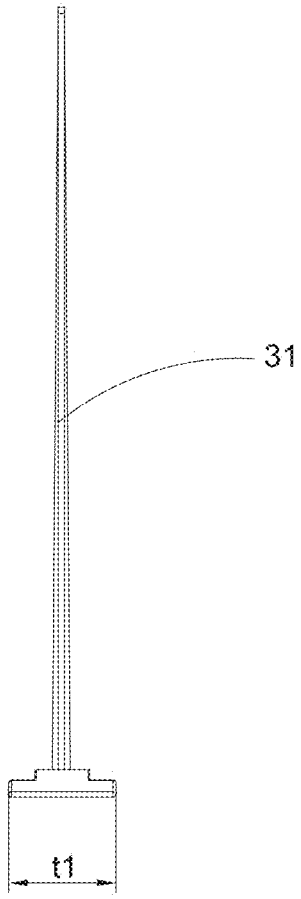
FIG. 15 a cross-sectional view illustrating the first central rear fin of the inflatable paddle board according to the above preferred embodiment of the present invention.

As shown in FIG. 15 of the drawings, the first rear fin body 312 of the first central rear fin 31 is preferred to have a gradually increasing thickness t1 from a top end to a bottom end, a maximum thickness of the first rear fin body 312 is preferred to be 3 mm-10 mm. A thickness of the first rear base assembling base 311 is preferred to be ranged from 10 mm-50 mm.

The person of ordinary skilled in the art should understand that the shape and size of each of the second rear fins 32 is also not limited in the present invention. In the present invention, each of the second rear fins 32 is preferred to have a height h2 that is ranged from 50 mm-200 mm, a width w2 that is ranged from 50 mm-150 mm. As shown in FIG. 16A of the drawings, as an example, the height h2 of each of the second rear fins 32 is 118 mm, the width of each of the second rear fins 32 is 129 mm.

Figure 16B:
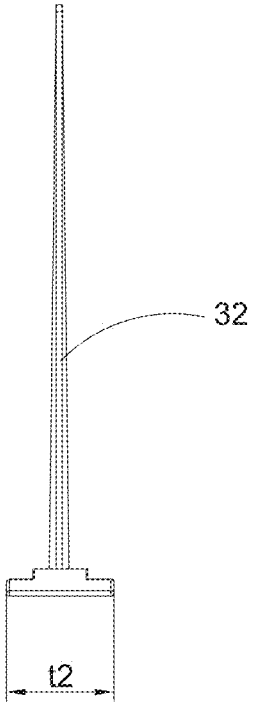
FIG. 16B a cross-sectional view illustrating the second rear fin of the inflatable paddle board according to the above preferred embodiment of the present invention.

As shown in FIG. 16B of the drawings, the second rear fin body 322 of each of the second rear fins 32 is preferred to have a gradually increasing thickness t2 from a top end to a bottom end, a maximum thickness of each second rear fin body 322 is preferred to be 3 mm-10 mm. A thickness of the second rear base assembling base 321 is preferred to be ranged from 10 mm-30 mm.

In addition, a length of the rear fixing holder 17 is preferred to be ranged from 150 mm-350 mm, a width of the rear fixing holder 17 is preferred to be ranged from 50 mm-150 mm, a height of the rear fixing holder 17 is preferred to be ranged from 5 mm-30 mm.

As an example of the rear fixing holder 17 for the first central rear fin 31, the length thereof can be 243 mm, the width thereof can be 114 mm, and the height thereof can be 16 mm. As an example of the rear fixing holder 17 for the corresponding second rear fin 32, the length thereof can be 170 mm, the width thereof can be 80 mm, and the height thereof can be 11 mm.

Referring to FIG. 17 of the drawings, an inflatable paddle board according to a first alternative mode of the above preferred embodiment of the present invention is illustrated. In this embodiment, the one or more rear fins 32 only comprise the single first central rear fin 31.

Figure 18:
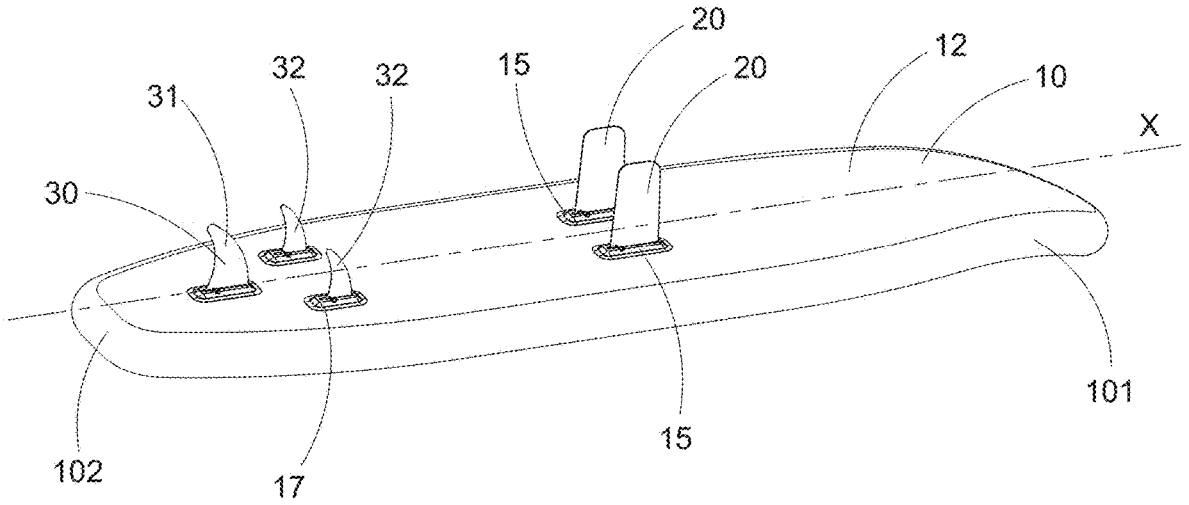
FIG. 18 is a perspective view illustrating of an inflatable paddle board according to a second alternative mode of the above preferred embodiment of the present invention.

Referring to FIG. 18 of the drawings, an inflatable paddle board according to a second alternative mode of the above preferred embodiment of the present invention is illustrated. In this embodiment, the inflatable paddle board may comprise two central balancing fins 20 which are symmetrically distributed at two opposite sides of the central line X of the bottom surface 121 of the hull portion 12.

The center line 201 of each central balancing fin 20 is aligned with the center position 122 of the bottom surface 121 of the hull portion 12 or is deviated from the center position 122 of the bottom surface 121 of the hull portion 12 along the length direction of the board body 10 within an allowable value range which is not more than 30 cm, so that the two central balancing fins 20 are located at a central area under the hull portion 12 to provide the enhanced balancing effect and to improve the navigation performance.

Figure 19:
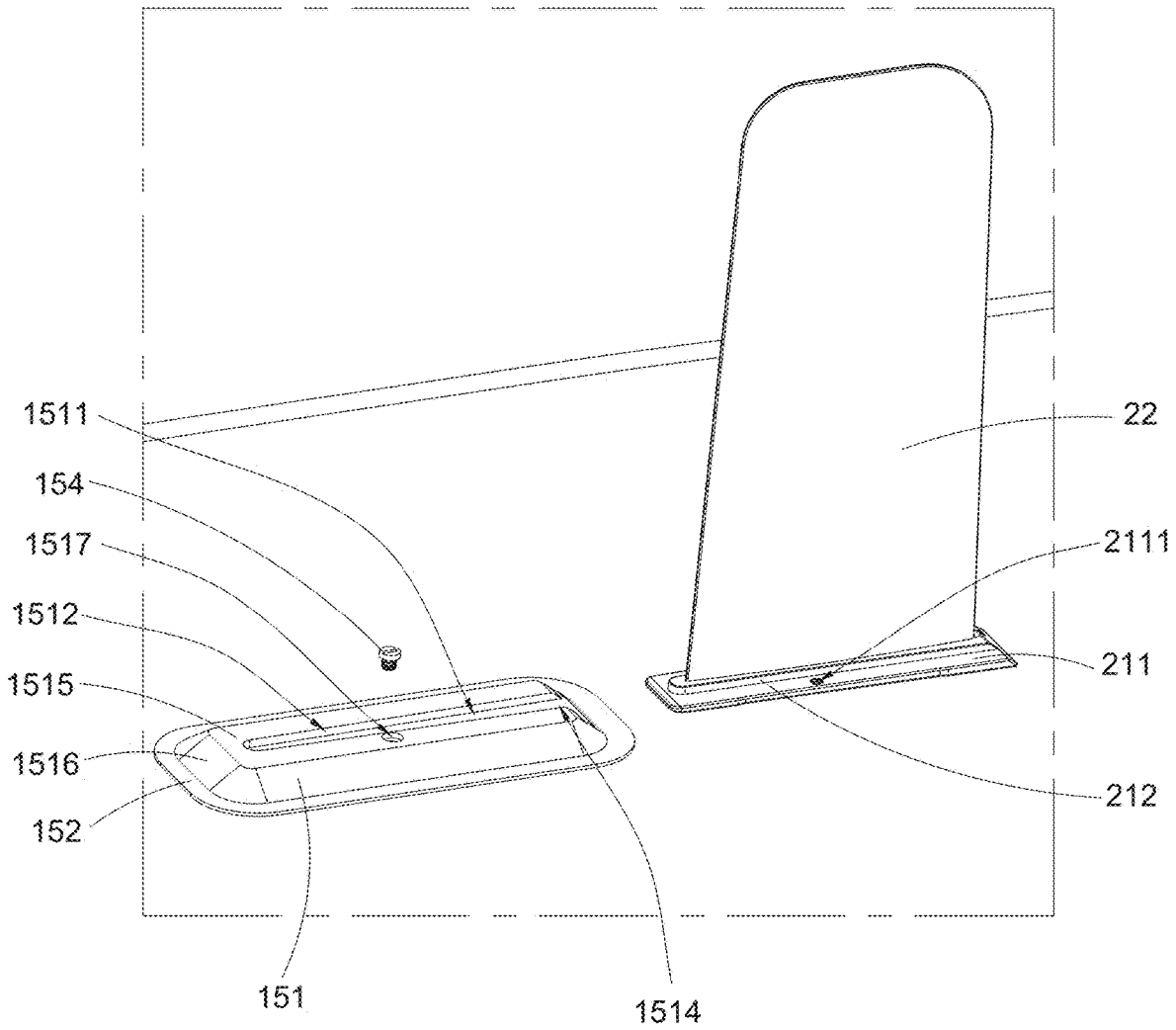
FIG. 19 is an partial enlarged view illustrating of the coupling between the central balancing fin and the fixing holder of the inflatable paddle board according to a third alternative mode of the above preferred embodiment of the present invention.
Figure 20:
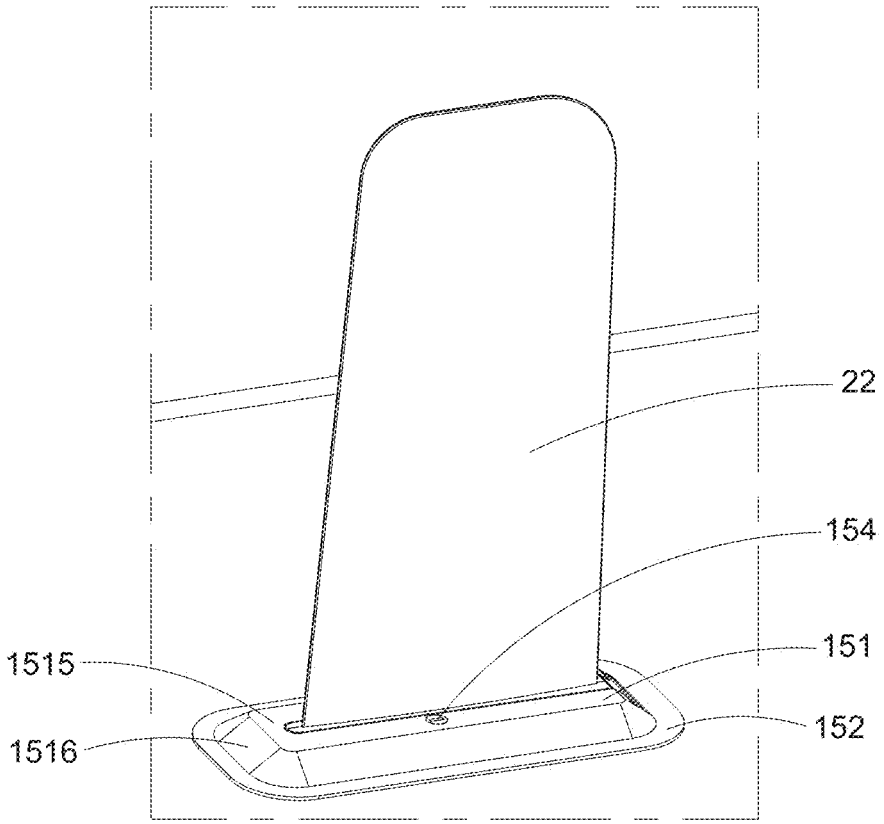
FIG. 20 is an partial enlarged view illustrating the central balancing fin being fixed on the fixing holder of the inflatable paddle board according to the above third alternative mode of the above preferred embodiment of the present invention.

Referring to FIG. 19 and FIG. 20 of the drawings, an inflatable paddle board according to a third alternative mode of the above preferred embodiment of the present invention is illustrated. In this embodiment, the connecting manner between the central balancing fin 20 and the fixing holder 15 is different from the above preferred embodiment.

More specifically, the base body portion 211 of the assembling base 21 of the central balancing fin 20 has an assembling hole 2111, the holding body 151 has a fixing hole 1517, and the fixing holder 15 further comprises a fixing element 154 such as a screw which can be screwed into the assembling hole 2111 of the base body portion 211 of the assembling base 21 of the central balancing fin 20 and the fixing hole 1517 of the holding body 151, so as to firmly assemble the central balancing fin 20 to the fixing holder 15.

Figure 21:
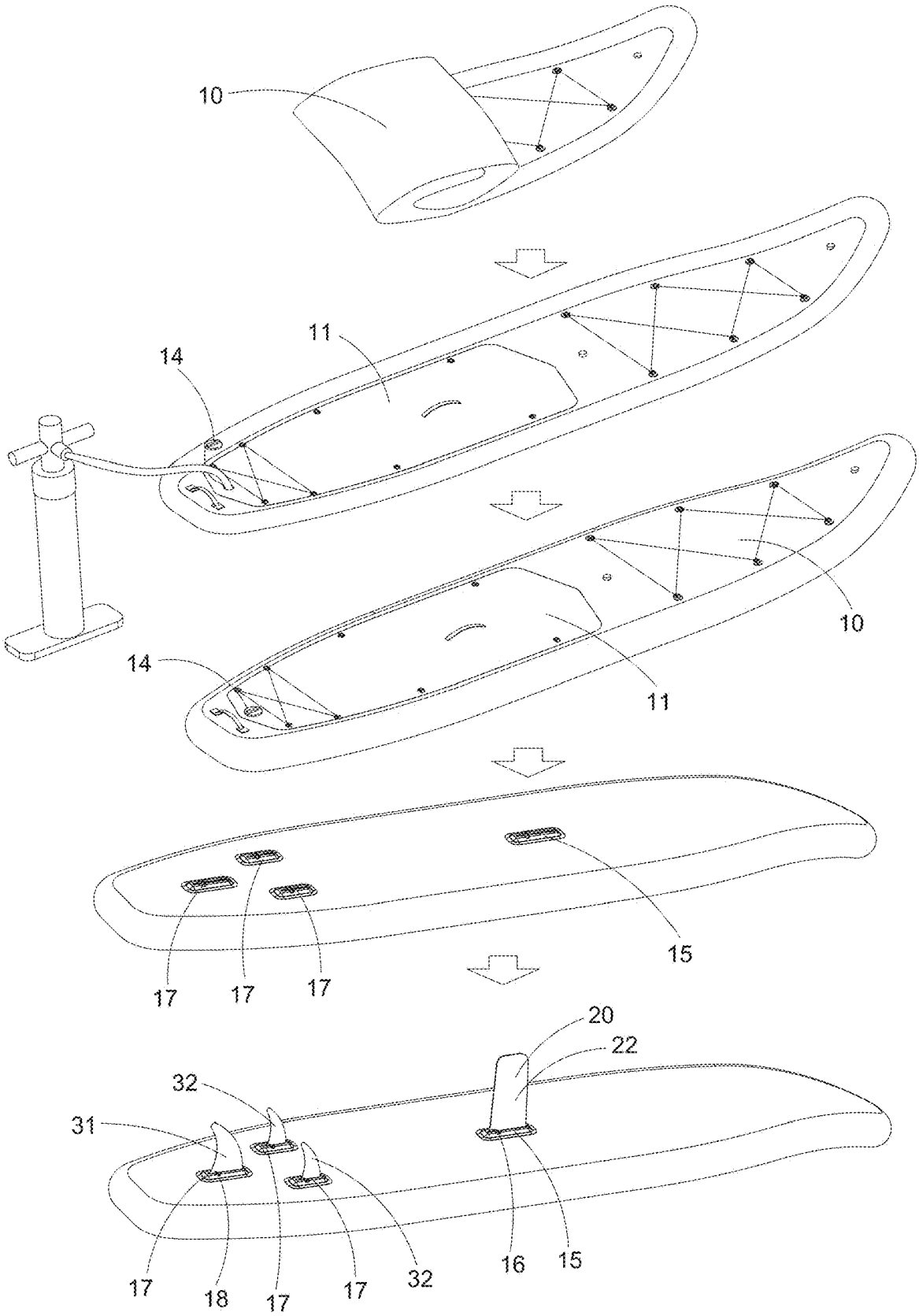
FIG. 21 is a perspective view illustrating the assembling of the inflatable paddle board before using according to the above preferred embodiment of the present invention.
Figure 22:
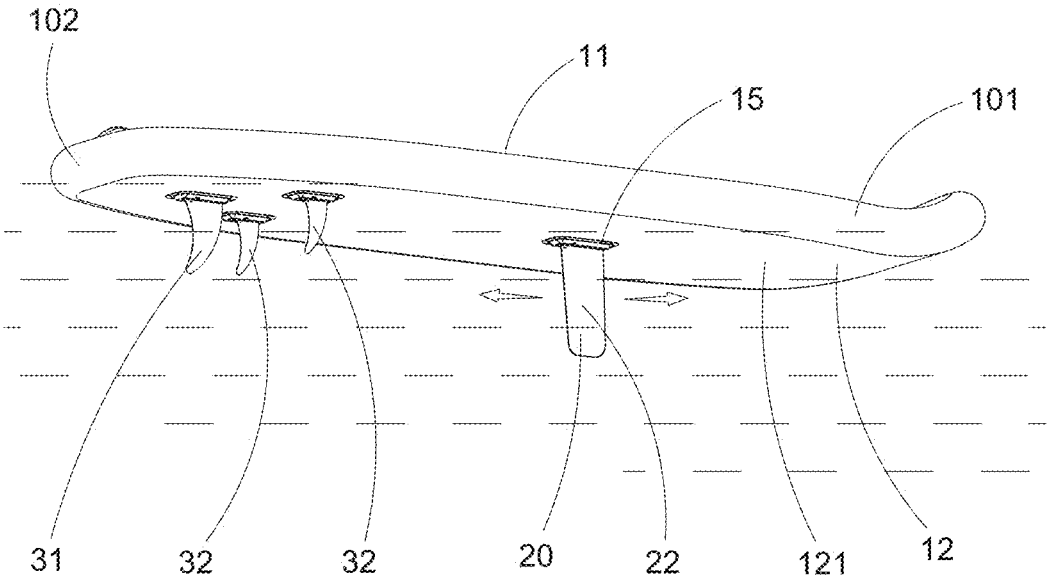
FIG. 22 is a perspective view illustrating the inflatable paddle board being in the water according to the above preferred embodiment of the present invention.

Referring to FIG. 21 of the drawings, when preparing the inflatable paddle board of the present invention before paddling, the inflatable paddle board which is rolled up can be unrolled and laid flat to expose the air valve 14, an air pumping device can be employed to inflate the board body 10. And then the central balancing fin 20 and the one or more rear fins 30 can be respectively assembled to the fixing holder 15 and the rear fixing holder 17 on the bottom surface 121 of the hull portion 12 of the board body 10. Alternatively, the assembling of the central balancing fin 20 and the one or more rear fins 30 can be carried out before the inflating step.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. An inflatable paddle board, comprising:

a board body which is inflatable, wherein the board body has a bottom surface and defines a center position on the bottom surface and a centerline along a length direction of the board body; and a central balancing fin downwardly extended from the bottom surface of the board body at the center position thereof and aligned along the centerline of the board body;

wherein the board body further comprises:

a fixing plate fixed to the bottom surface of the board body, wherein the fixing plate comprises a row of positioning holes formed along a centerline of the fixing plate, two bottom grooves formed along two opposite sides of the fixing plate, such that the row of the positioning holes are located between the two bottom grooves, and a plurality of reinforcing ribs provided at each of the bottom grooves to enhance a strength of the fixing plate; and a holding body extended from the fixing plate, wherein the holding body has a holding channel, such that the central balancing fin is slid along the holding channel to detachably couple at the bottom surface of the board body.

2. The inflatable paddle board, as recited in claim 1, wherein the central balancing fin comprises a fin body having a trapezoid shape, wherein the fin body has a first edge slidably encased with the holding channel to detachably couple the fin body at the bottom surface of the board body, a second edge which is shorter than the first edge and is parallel to the first edge, and two inclined side edges extended between the first edge and the second edge to define a front round corner between the second edge and one of the inclined side edges and a rear round corner between the second edge and another inclined side edge, wherein a front corner radii of the front round corner is larger than a rear corner radii of the rear round corner.

3. The inflatable paddle board, as recited in claim 1, further comprising two rear fins which are downwardly extended from the bottom surface of the board body at a rear end portion thereof and are symmetrically distributed on two opposite sides of the centerline of the board body.

4. The inflatable paddle board, as recited in claim 3, wherein each of the rear fins, having a triangular shape, has a base edge extended from the bottom surface of the board body, a streamlined front curve edge and an arched rear curve edge, wherein a width of each of the rear fins is smaller than a width of the fin body of the central balancing fin, wherein a height of each of the rear fins is smaller than a height of the fin body of the central balancing fin.

5. The inflatable paddle board, as recited in claim 4, further comprising a central rear fin downwardly extended from the bottom surface of the board body at the rear end portion thereof and aligned along the centerline of the board body so as to align with the central balancing fin;

wherein the central rear fin, having a triangular shape, has a base edge extended from the bottom surface of the board body, a streamlined front curve edge and an arched rear curve edge, a size of the first central rear fin is smaller than the size of the fin body and is larger than the size of each of the rear fins.

6. The inflatable paddle board, as recited in claim 5, wherein the two rear fins and the central rear fin are detachably coupled at the bottom surface of the board body at the rear end portion thereof, such that the two rear fins and the central rear fin are selectively coupled at the board body to incorporate with the central balancing fin.

7. The inflatable paddle board, as recited in claim 2, wherein the fin body has a height which is ranged from 150 mm-500 mm and a width which is ranged from 100 mm-400 mm.

8. The inflatable paddle board, as recited in claim 1, wherein the fin body has a gradually increasing thickness toward the bottom surface of the board body, wherein a maximum thickness of the fin body is 3 mm-30 mm.

9. The inflatable paddle board, as recited in claim 1, wherein the central balancing fin is made of a material selected from the group consisting of polypropylene, polyamide, and polycarbonate.

10. An inflatable paddle board, comprising:

a board body which is inflatable, wherein the board body has a bottom surface and defines a center position on the bottom surface and a centerline along a length direction of the board body;

a group of central balancing fins downwardly extended from the bottom surface of the board body at the center position thereof; and a rear fin structure downwardly extended from the bottom surface of the board body at a rear end portion thereof.

11. The inflatable paddle board, as recited in claim 10, wherein the group of central balancing fins comprises two central balancing fins symmetrically located at two opposite sides of the centerline of the board body.

12. The inflatable paddle board, as recited in claim 11, wherein the rear fin structure comprises:

a first rear fin which is downwardly extended from the bottom surface of the board body at the rear end portion thereof and is aligned along the centerline of the board body; and two second rear fins which are downwardly extended from the bottom surface of the board body at the rear end portion thereof and are symmetrically distributed on two opposite sides of the centerline of the board body.

13. The inflatable paddle board, as recited in claim 12, wherein the first rear fin is located behind the two second rear fins.

14. The inflatable paddle board, as recited in claim 12, wherein a size of each of the second rear fins is smaller than a size of the first rear fin and is smaller than a size of each of the central balancing fins.

15. The inflatable paddle board, as recited in claim 12, wherein the second rear fins are aligned with the two central balancing fins respectively.

16. The inflatable paddle board, as recited in claim 11, wherein the two central balancing fins are identical, wherein each of the central balancing fins comprises a fin body having a first edge extended from the bottom surface of the board body, a second edge which is shorter than the first edge and is parallel to the first edge, and two inclined side edges extended between the first edge and the second edge to define a front round corner between the second edge and one of the inclined side edges and a rear round corner between the second edge and another inclined side edge, wherein a front corner radii of the front round corner is larger than a rear corner radii of the rear round corner.

17. The inflatable paddle board, as recited in claim 16, wherein each of the central balancing fins has a trapezoid shape.

18. The inflatable paddle board, as recited in claim 16, wherein each of the central balancing fins is detachably coupled at the bottom surface of the board body.

* * * * *